United States Patent [19]

Roch

[11] Patent Number: 4,756,245

[45] Date of Patent: Jul. 12, 1988

[54] PRINTING PRESS HAVING VARIOUS PRINTING HEADS

[76] Inventor: Yvan Roch, 1015 St. Michel Boulevard, Montreal, Canada, H1H 5A6

[21] Appl. No.: 619,883

[22] Filed: Jun. 12, 1984

[51] Int. Cl.[4] ..... B41F 13/28; B41F 13/54

[52] U.S. Cl. ..... 101/76; 101/227; 101/234; 101/375; 101/246; 101/247

[58] Field of Search ..... 101/216, 232, 76, 233, 101/234, 136, 141, 144, 375, 409, 247, 246, 226, 227, 375, 246, 409, 410; 83/495, 665, 684; 271/665, 495

[56] References Cited

U.S. PATENT DOCUMENTS

| | | | |
|---|---|---|---|
| 1,920,232 | 8/1933 | Allen | 101/177 |
| 2,387,750 | 10/1945 | Davidson | 101/218 |
| 2,525,931 | 10/1950 | Morse | 101/375 |
| 2,683,409 | 7/1954 | Durto et al. . | |
| 3,068,788 | 12/1962 | Bell et al. . | |
| 3,106,121 | 10/1963 | Novick . | |
| 3,203,292 | 8/1965 | Schmermund . | |
| 3,221,652 | 12/1965 | Mestre | 101/232 |
| 3,363,554 | 1/1968 | Mestre | 101/248 |
| 3,431,847 | 3/1969 | Smith et al. . | |
| 3,524,922 | 8/1970 | Johnson . | |
| 3,554,070 | 1/1971 | Boyd . | |
| 3,583,269 | 6/1971 | Kobayashi . | |
| 3,593,987 | 7/1971 | Garber . | |
| 3,611,921 | 10/1971 | Jahn . | |
| 3,728,960 | 4/1973 | Heath | 101/216 X |
| 4,044,666 | 8/1977 | Doucet . | |
| 4,228,735 | 10/1980 | Doucet . | |
| 4,262,590 | 4/1981 | Bruckner | 101/216 X |
| 4,369,703 | 1/1983 | Jarach | 101/216 X |

*Primary Examiner*—J. Reed Fisher

[57] ABSTRACT

A self-standing printing apparatus is described which includes a paper feeder for feeding individual sheets of paper, an impression cylinder and an accessory shaft adjacent the impression cylinder on which various types of printing heads may be mounted, including a numbering device. A counter roller may also be provided adjacent the impression cylinder for perforating the paper against perforating strips which may be provided on the surface of the impression cylinder. The impression cylinder is adapted to move out of contact with the various printing heads on the accessory shaft and the counter roller when the paper supply is interrupted. As the paper supply is reinstated, the impression cylinder automatically moves back into position. A particular paper supply and transfer device is also described as well as a novel inking unit. A stacking plate for stacking the printed sheets along with jogger devices are provided.

11 Claims, 20 Drawing Sheets

FIG. 14
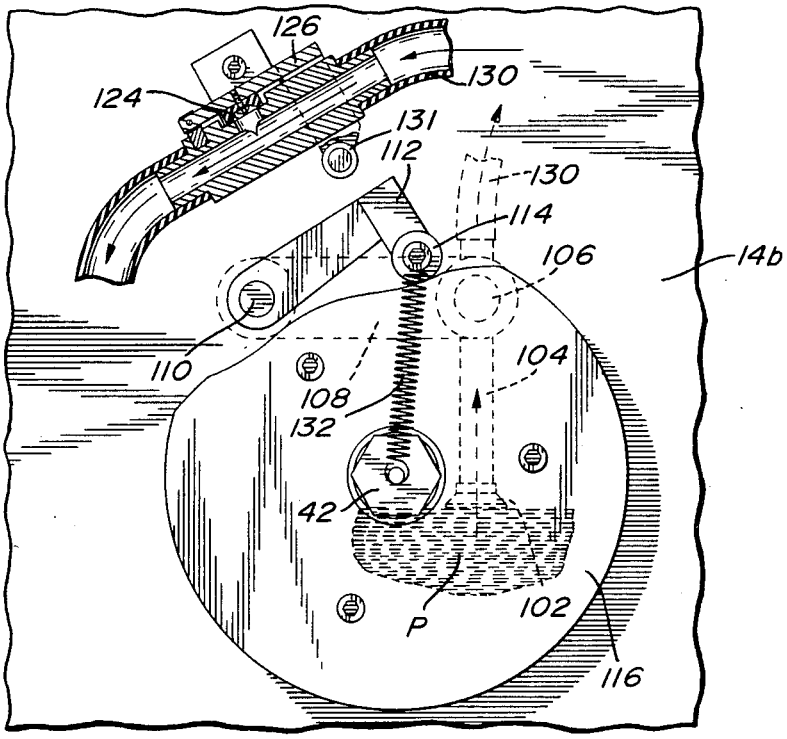
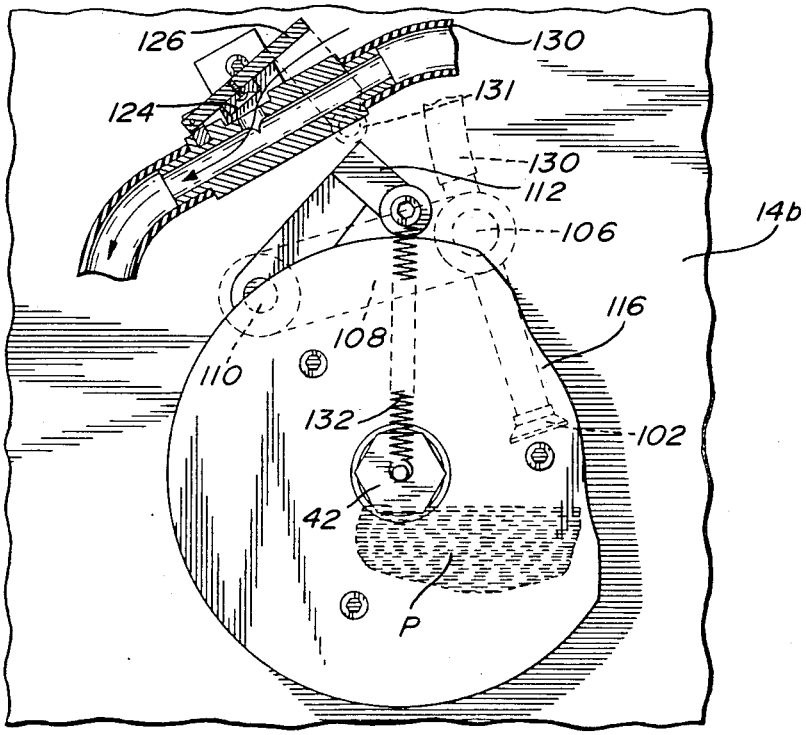
FIG. 15

24
20
14b
400
170
424
172
178
166
428
430
432
410
404
422
426
400
420

238
236
242
240
246
264
248
187
186'
270
268
265
244
14a
14a
266
186
262
267
260
14a
231
254
258
228
252
256
230
14b
152
14b
20
14a
250

PRINTING PRESS HAVING VARIOUS PRINTING HEADS

BACKGROUND OF THE INVENTION

1. Field of the Invention

The present invention relates to an apparatus for printing individual sheets of paper, and more particularly, to an apparatus for numbering, perforating, and printing sheets of paper.

2. Description of the Prior Art

Traditionally, "letterpress" techniques for printing sheets require reciprocating platens, and accessories must be provided for numbering and perforating the sheets. Such techniques have limitations, such as low speed, as compared with "flexographic" printing presses which utilize soft printing plates on a cylinder but are traditionally limited to printing continuous webs of paper, normally from a roll.

Offset printing, on the other hand, has been developed to incorporate rotary printing techniques with the sheet feed apparatus. Numbering devices with proper interrupters have been developed for such an offset machine as described in U.S. Pat. No. 2,683,409, Durto et al, 1954. Further, various perforating machines have been incorporated in such offset presses for perforating the sheets.

However, the numbering apparatus is normally an add-on feature and requires a second impression cylinder as with the perforator or cutting features. Furthermore, offset printing is subject to limitations which prevent it from having the versatility of printing of a letterpress or flexographic printing press.

SUMMARY OF THE INVENTION

It is an aim of the present invention to provide a compact simple stand-alone press which has the certain advantages of an offset press but which can incorporate the features of the letterpress or flexographic press.

It is also an aim of the present invention to provide a rotary printinng press with perforating, numbering, and printing features about a single impression cylinder.

It is a further aim of the present invention to provide an improved paper feed mechanism for feeding single sheets of paper.

It is also an aim of the present invention to provide an improved interrupter which will disengage the impression cylinder from contact with the various perforating, printing, and numbering devices when the supply of sheets is interrupted.

It is also an aim of the present invention to provide an improved ink unit.

It is a further aim of the present invention to provide an improved delivery and stacking system for use with a printing press.

Essentially the printing press of the present invention comprises a frame, an impression cylinder mounted for rotation on the frame, and means for feeding sheets of paper to the impression cylinder. Means are provided on the impression cylinder for retaining the sheet of paper on the surface of the impression cylinder as it rotates through a predetermined arc. A shaft is mounted on the frame in spaced and parallel relationship to the axis of rotation of the impression cylinder and is contained within the arc. Means are provided for driving the impression cylinder and the shaft in registry. Means are provided for mounting on the shaft a numbering device, a lettering head and/or a flexographic printing cylinder on the shaft, either any one of these elements or all three of them. The letterpress head, the numbering device, and the flexographic printing cylinder are mounted such that they contact the impression cylinder surface within the arc. Ink feeding means are provided, including at least an ink roller for transferring printing ink to the printing devices on the shaft, that is, the numbering device, letterpress head and/or the flexographic printing cylinder. Means are also provided for removing the sheet from the impression cylinder at the end of the predetermined arc.

A construction in accordance with the present invention comprises a printing apparatus including an impression cylinder, means for supplying sheets one by one to the impression cylinder, gripping means on the impression cylinder for gripping an edge of a sheet and advancing the sheet so that it envelops about the impression cylinder, perforating means including strips of teeth adapted to be fixed to the surface of the impression cylinder, counter roller means for pressing the sheet against the perforating teeth, shaft means mounted parallel to the axis of the cylinder and having a keyway, the shaft means being driven in register with the impression cylinder, the shaft means being adapted to receive and mount at least one of a numbering means, a letterpress head, and a printing cylinder for printing intelligence on the sheet on the impression cylinder, interrupter means for disengaging the impression cylinder and moving it from the locus of the at least one of the numbering means, the letterpress head, and the printing means, inking means including a plurality of successive rollers with a transfer roller adapted to intersect the circular locus of the surface of the at least one of the numbering means, letterpress head, and printing cylinder, and means for removing the sheet from the impression roller and stacking the sheet.

One of the important features of the present invention is the provision of the various printing devices and the numbering device operable on and coordinated with the impression cylinder. In the past, particularly in an offset press, the numbering apparatus could be a separate add-on feature which required further equipment, such as an impression roller. It is also contemplated that in the case of multi-colour printing, the printing unit may be repeated in series, wherein the printing unit includes an impression cylinder and an accessory shaft to which can be mounted different printing heads, such as a printing cylinder with flexographic printing pads or a letterpress device. As many head units including the impression cylinder and the ink unit and the accessory shaft as may be required can be added for the different colours to be utilized. Suitable transfer means is easily adapted for transfer of the sheet from one impression roller to the other.

The numbering accessory may be in the form of a numbering counter with a printing surface mounted on the accessory shaft for rotation thereon and in contact with the peripheral surface of the impression cylinder. A cam tripping device may be mounted adjacent the path of the numbering head with means for successively changing the number on the numbering head for each cycle of the numbering head.

The counter roller in the present invention may have a longitudinally convex outer sleeve, and the axis of the counter roller would be parallel to the axis of the impression cylinder as opposed to the conventional concave angled counter roller. The convex sleeve on the roller provides compensation for the deflection of the sleeve, particularly in the center area when pressuring the paper against the preforation teeth.

BRIEF DESCRIPTION OF THE DRAWINGS

Having thus generally described the nature of the invention, reference will now be made to the accompanying drawings, showing by way of illustration, a preferred embodiment thereof, and in which:

FIG. 14 is a fragmentary elevation showing partly in cross-section a further detail of the paper transfer mechanism;

FIG. 15 is a view similar to FIG. 14 but showing the elements therein in a different operative position;

DESCRIPTION OF THE PREFFERED EMBODIMENTS

Figure 1:
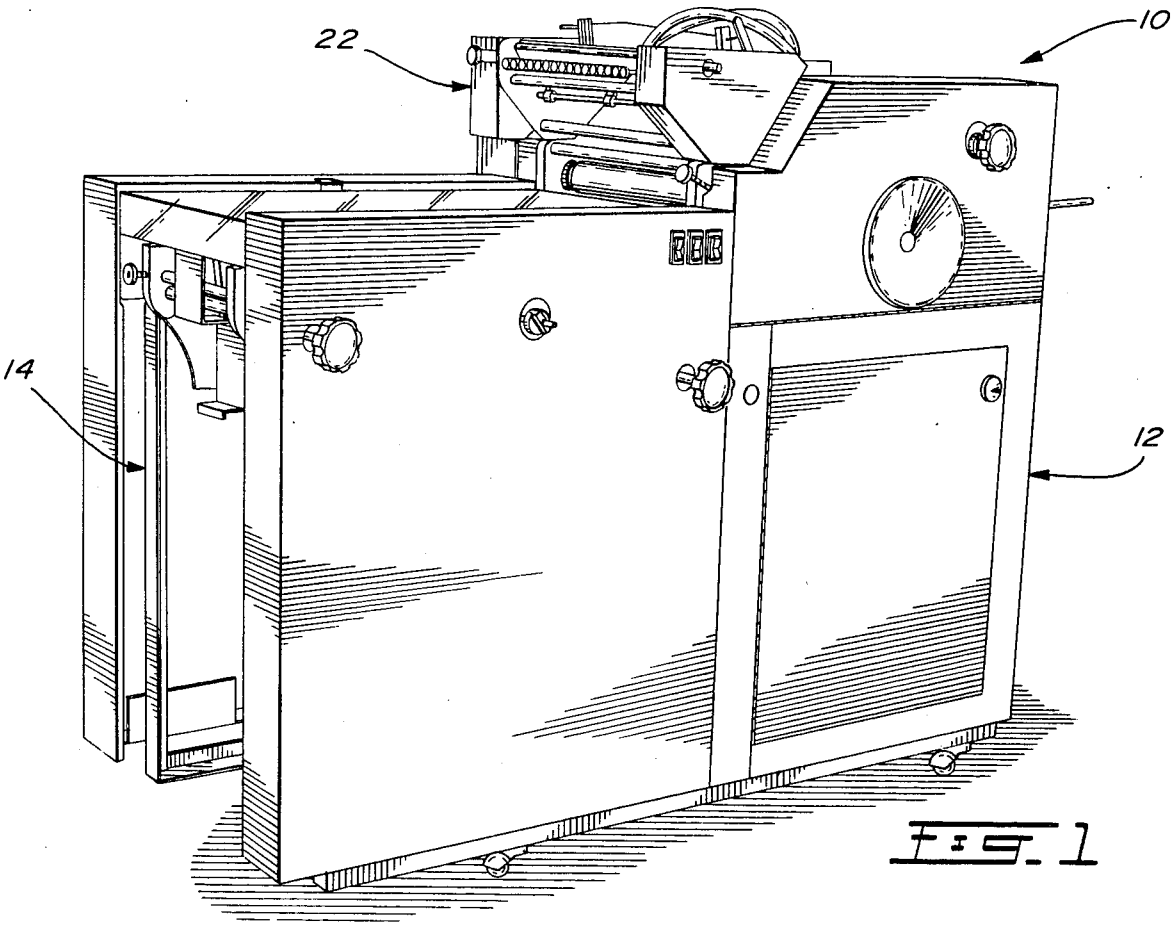
FIG. 1 is a perspective view of the printing press.

Reffering now to the drawings, the printing press 10 is shown in FIGS. 1 to 5 as having a frame 14 mounting the various units of the press 10 which, in FIG. 1, is covered by a housing 12. At the feed end of the apparatus, there is provided a paper supply unit 16, a paper transfer unit 18, an impression cylinder 20 with the accompanying accessory shaft for mounting the printing heads, and an ink unit 22. A chain delivery system 24 transfers the printed sheet from the impression cylinder 20 and carries the sheet to the stacker 26.

Before proceeding, it should be mentioned that the driven parts of the press 10 are taken off from a drive strap S (shown in FIG. 3) which is connected to a suitable drive source and which rotates a pulley W.

Figure 2:
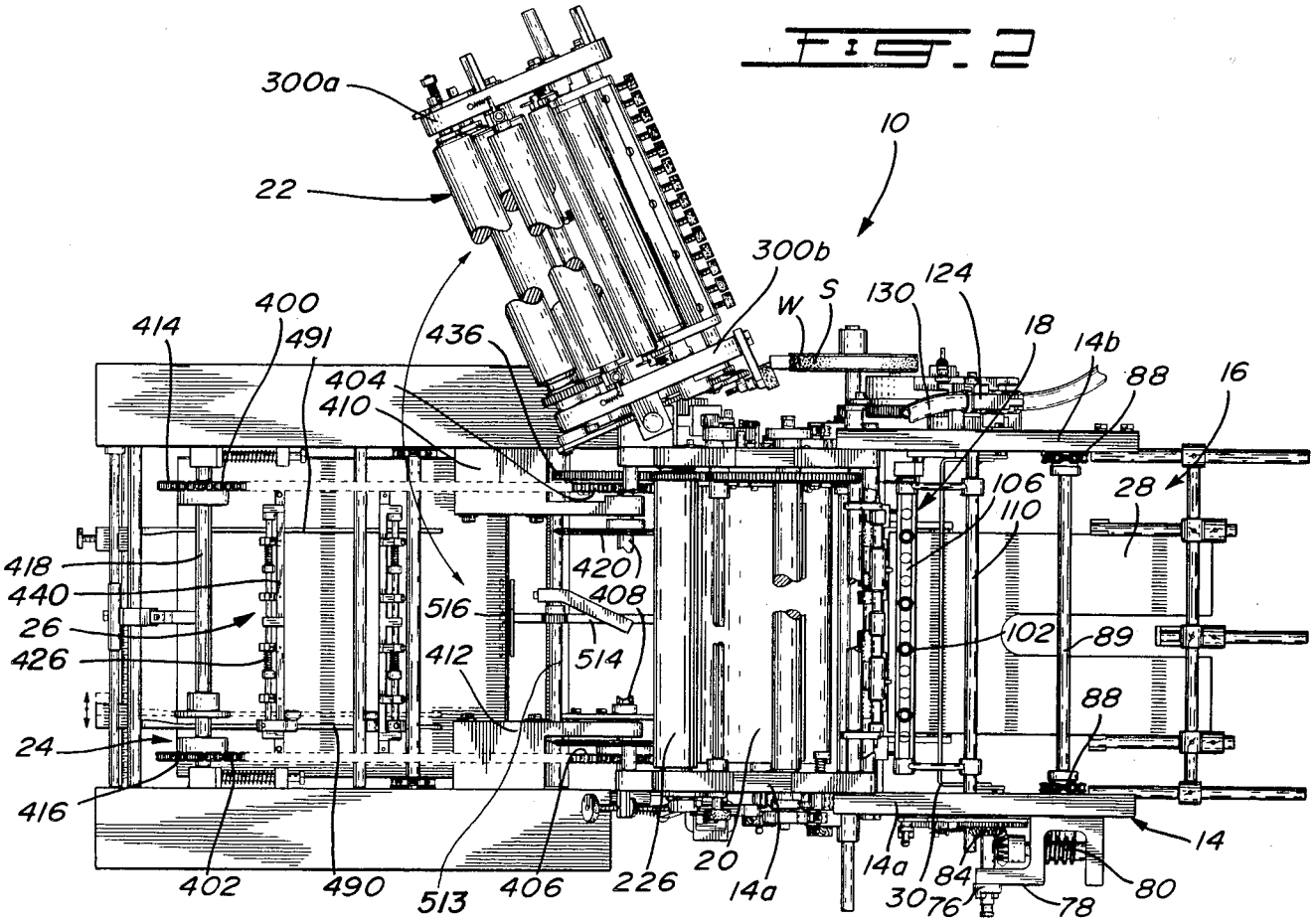
FIG. 2 is a top plan view of a printing press in accordance with the present invention with the housing removed.
Figure 3:
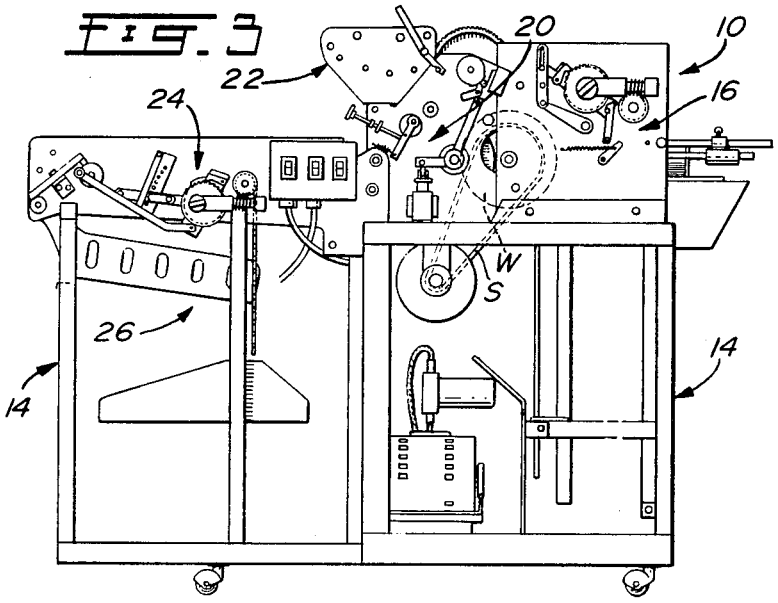
FIG. 3 is a side elevation of the printing press in accordance with the present invention.

The paper supply is best illustrated in FIGS. 2, 4, 5, 6, 7, 9 and 10. The paper supply 16 is provided with a platform 28 which is arranged to move along a vertical axis by following in tracks 29. The platform is fixed to a chain 88, the movement of which will be described herein. There is a chain 88 on both sides of the platform 28 as can be seen in FIG. 2.

It is important that the top level of the paper be always in a predetermined horizontal plane such that the transfer mechanism 18 can pick off sheets one at a time to feed the sheets to the impression cylinder 20. There are numerous mechanical well-known devices for accomplishing this particular purpose. A novel mechanical arrangement will be described herein.

FIGS. 7, 8, 9 and 10 illustrate the mechanical linkages for intermittently raising the platform having a supply of sheets P to maintain the top level of the supply of paper P in a predetermined horizontal plane.

A sensor bar 30 is fixed to pivot pins on either side of the paper supply and passes through parallel walls **14*a* and 14*b* which form part of the frame 14. Pivot pin 31 passes through wall 14*b* and mounts a crank arm 36 to which is mounted a cam follower 38. The cam follower 38 follows along the periphery of cam wheel 40** mounted to driven shaft 42. The sensor arm 30 is normally maintained in an upper position free of the supply of paper P, as shown in dotted lines in FIGS. 6 and 9, by the cam wheel 40. As the cutaway portion 40*a* of the cam 40 passes the cam follower 38, the sensor bar 30 (see FIG. 7) will rotate downwardly to engage and sense the top surface of the paper supply P.

The other end of the sensor bar 30 mounts a pivot pin 32*a* passing through wall 14*a* to which a lever 32 is fixed. A spring 34 urges the lever 32 in a counterclockwise direction and maintains pressure on the cam follower 38 on the other side of the housing against the periphery of the cam wheel 40.

On the wall 14*a*, a lever 44 is pivoted to a pivot shaft 72. At the other end of the lever 44 is a link 46 pivoted to the lever 44 at the pivot pin 74. The link 46 is provided with an enlongated slot 48 adapted to receive a pin 86 mounted on a pivoting bar 52 which will be described. A spring 47 is connected at one end to the link 46 and at the other end to the pin 86.

The pivoting arm 52 is mounted on the shaft 60. At one end of the arm 52 is provided a pin 54 adapted to be engaged by a locking lever 64. Locking lever 64 includes a notch 70 and is pivoted to pin 66 on the wall 14*a*. A spring 68 urges the locking lever 64 so that its notch 70 will engage the pin 54 on the bar 52.

Figure 10:
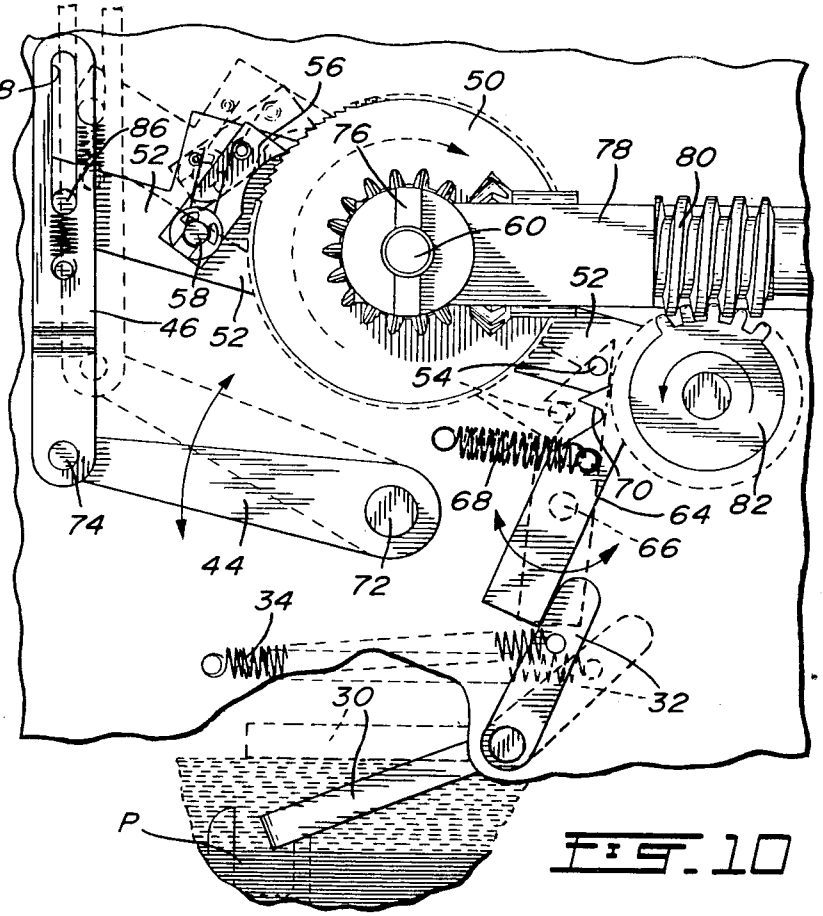
FIG. 10 is a view similar to FIG. 8 but showing the elements in a different operative position.
Figure 9:
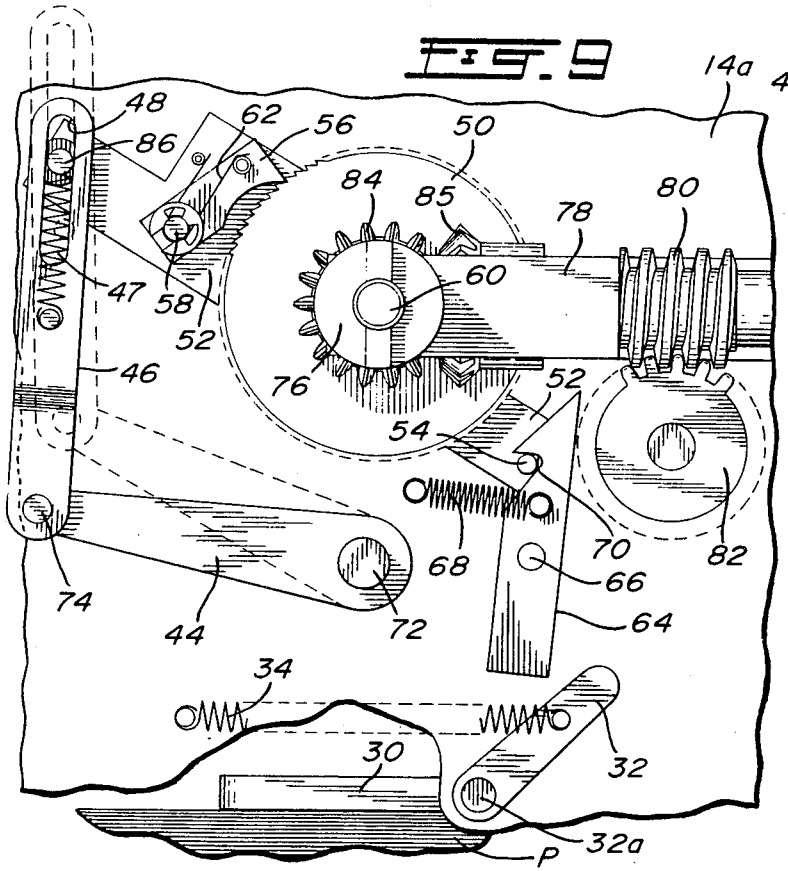
FIG. 9 is a fragmentary elevation showing a detail of the paper supply mechanism.

A saw-toothed wheel 50 is mounted on shaft 60. The teeth are directed counterclockwise in order to enable a ratchet means 56, 58, 62 to engage the teeth, as shown in FIGS. 9 and 10. More specifically a ratchet lever 56 is pivotally mounted on pivot pin 58 on the bar 52 and is urged against the teeth of the wheel 50 by means of a spring 62. As long as the ratchet lever 56 engages the teeth of the wheel 50, the wheel 50 is prevented from rotating counterclockwise.

Fixed to the wheel 50 is a bevel gear 84 which mates with a bevel gear 85 connected at one end of a worm gear 80 and journaled in a bracket 78. The shaft 60 rotates in the journal 76 mounted to the bracket 78. The worm gear 80 mates with a gear 82 mounted to the end of a chain sprocket shaft 89 (see FIGS. 2 and 4). The arrangement is such that the clockwise movement of the wheel 50 will turn the gears so as to raise the chain 88 and thus the platform 28.

In operation, the lever 44 is driven in a reciprocating fashion (not shown, could ba a cam and follower on wall 14*b*). The stroke distance is shown in dotted lines in FIGS. 8 and 9 such as to reciprocate link 46 against the pin 86. As long as the arm 52 is retained by the locking lever 64, the pin 86 will not be influenced by the link 46 since the stroke of the link 46 is not greater than the length of the slot therein. However, if the notch 70 of locking lever 64 were to disengage the pin 54, the bar 52 would move counterclockwise by its weight and the urging of the spring 47 on the link 46. Thus, as the link 46 moves upwardly, as shown in FIG. 9, from its full line to its dotted line position, it engages the pin 86, thereby moving the bar 52 to rotate clockwise and thus advancing the ratchet lever 56, thereby rotating the wheel 50 in a clockwise direction and thus rotating the gears to elevate the platform 28 by means of the chains 88. However, the bar 52 is normally in the position shown in the FIG. 9 with the locking lever 64 in position on the pin 54.

For every cycle of the cam wheel 40, the sensor bar 30 will be allowed to move downwardly to engage the top surface of the paper supply P. At the same time that it moves downwardly, the lever 32 moves counterclockwise in FIG. 9 on the urging of the spring 34. If the level of the paper P has been lowered, the lever 32 may rotate far enough so as to engage lock lever 64, thereby pivoting in about pin 66 in a clockwise fashion to disengage notch 70 from the pin 54, and thus allow the bar 52 to move counterclockwise and be engaged by the link 46 which is continually reciprocating.

The cam 40 will cause the sensor bar 30 to return to its original position, as shown in dotted lines in FIG. 9, to thereby retract the lever 32. As the link 46 presses the bar 52 to rotate clockwise, the pin 54 again will engage the notch 70 on the lever 64. In the event that the paper supply is high enough, it is evident from these drawings that the bar 30 will not rotate far enough to allow the lever 32 to engage the lock lever 64.

Figure 13:
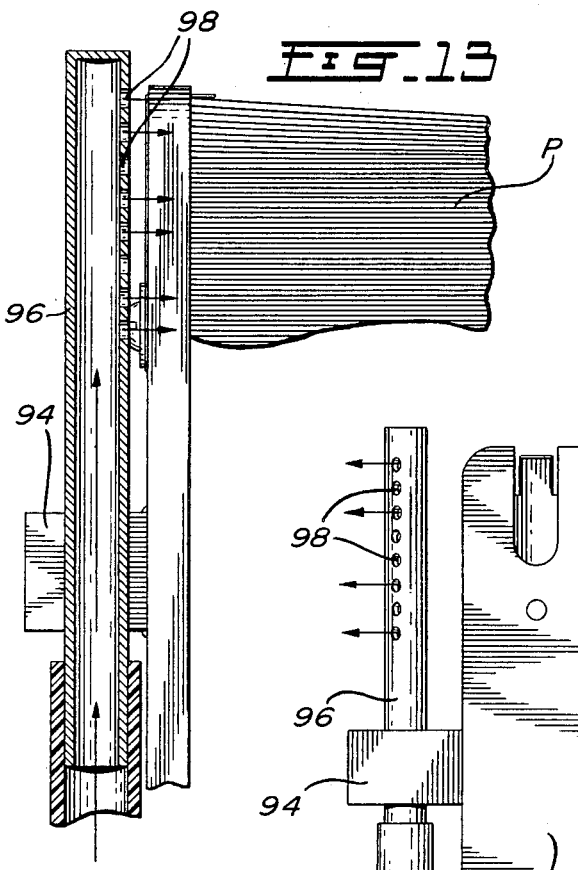
FIG. 13 is a vertical cross-section of the detail shown in FIGS. 11 and 12.
Figure 11:
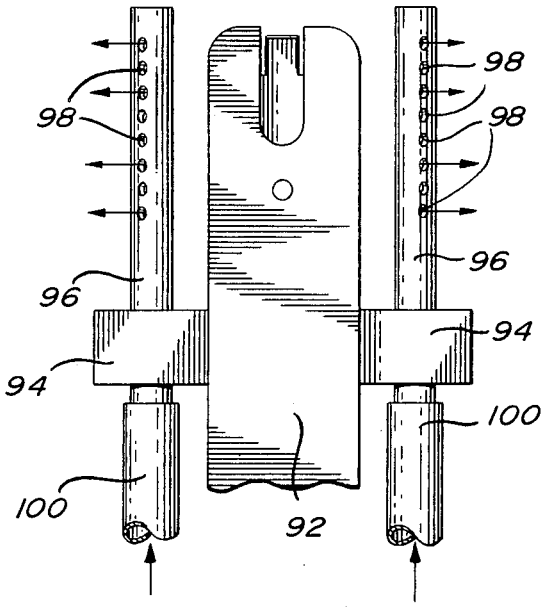
FIG. 11 is an enlarged elevational view of a detail of the paper supply mechanism.
Figure 12:
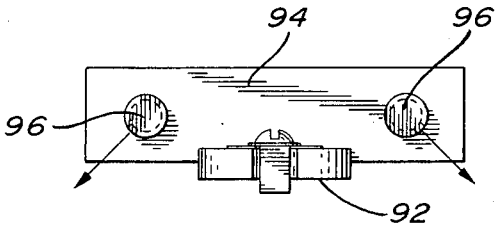
FIG. 12 is a top plan view thereof.

In order that the sheets of paper be easily removed from the supply, a small air device, as shown in FIGS. 11, 12, and 13, is provided forward of the platform 28 in order to fluff or lift the edges of the paper by air. The device comprises, for instance, a pair of upstanding air pipes 96 provided with a series of apertures 98. The pipes 96 are mounted on a cross bar 94 which in turn is mounted to a holder 92. Air to the pipes 96 is supplied by a flexible air pipes 100, as shown in the drawings. The apertures may be set at an angle to the longitudinal axis, to allow the best distribution of the jets of air forthcoming from the pipes 96. Although not shown, the cross bar or the pipes may be mounted for vertical adjustable movement in order to adjust the height of the air pipes 96.

The transfer mechanism comprises, in this embodiment, a plurality of suction cups 102, which are best shown in FIGS. 4, 5, 6, 14 and 15. The suction cups 102 are provided at the end of suction pipes 104 mounted on a bar 106 which is a journaled at its ends to a pair of arms 108 which in turn are mounted to a shaft 110. Also fixedly mounted to the shaft 110 on the other side of the wall 14*b* is a crank arm 112 to which is mounted a cam follower wheel 114 which follows on the periphery of the cam 116, as shown in FIGS. 14 and 15. At the end of the bar 106 is a lever 118 fixed thereto to which is mounted a cam follower wheel 120. The cam follower wheel is meant to follow cam slot 122 provided on the wall 14*b*.

Thus, in operation, the cam follower wheel 114 will follow the periphery of the cam 116 providing the vertical movement of the air pipes 104. However, as the arm 108 rotates clockwise, providing the vertical lift to the air pipes 104, the cam follower 120 will follow in the slot 122 rotating the bar 106 relative to the arms 108 in a further clockwise direction, thereby pivoting the air pipes 104, thus advancing the suction cups 102 towards the nip formed by the drive roller 134.

When the air pipes 104 have reached their position of maximum upward extention, the cam follower 114 will be riding on the area of the greatest radius of the cam 116, as shown in FIG. 15. At that point, the crank arm 112 will engage the cam wheel 131 at the end of the valve lever 126 on the air pipe 130 just above the cam wheel 116. Thus, the valve 124 will be opened, allowing atmospheric air to enter the vacuum air pipe 130, releasing the vacuum in the suction cups 102. Thus, the paper P is released from the suction cups 102 and is picked up by the drive roller 134.

As the suction pipes 104 and the suction cups 102 move back down to their position above the paper supply P, as shown in FIG. 14, the crank arm 112 will disengage the cam wheel 131, allowing the lever 126 to close the valve 124 and maintain a vacuum in the air pipe 130 to the suction cups 102.

Figure 5:
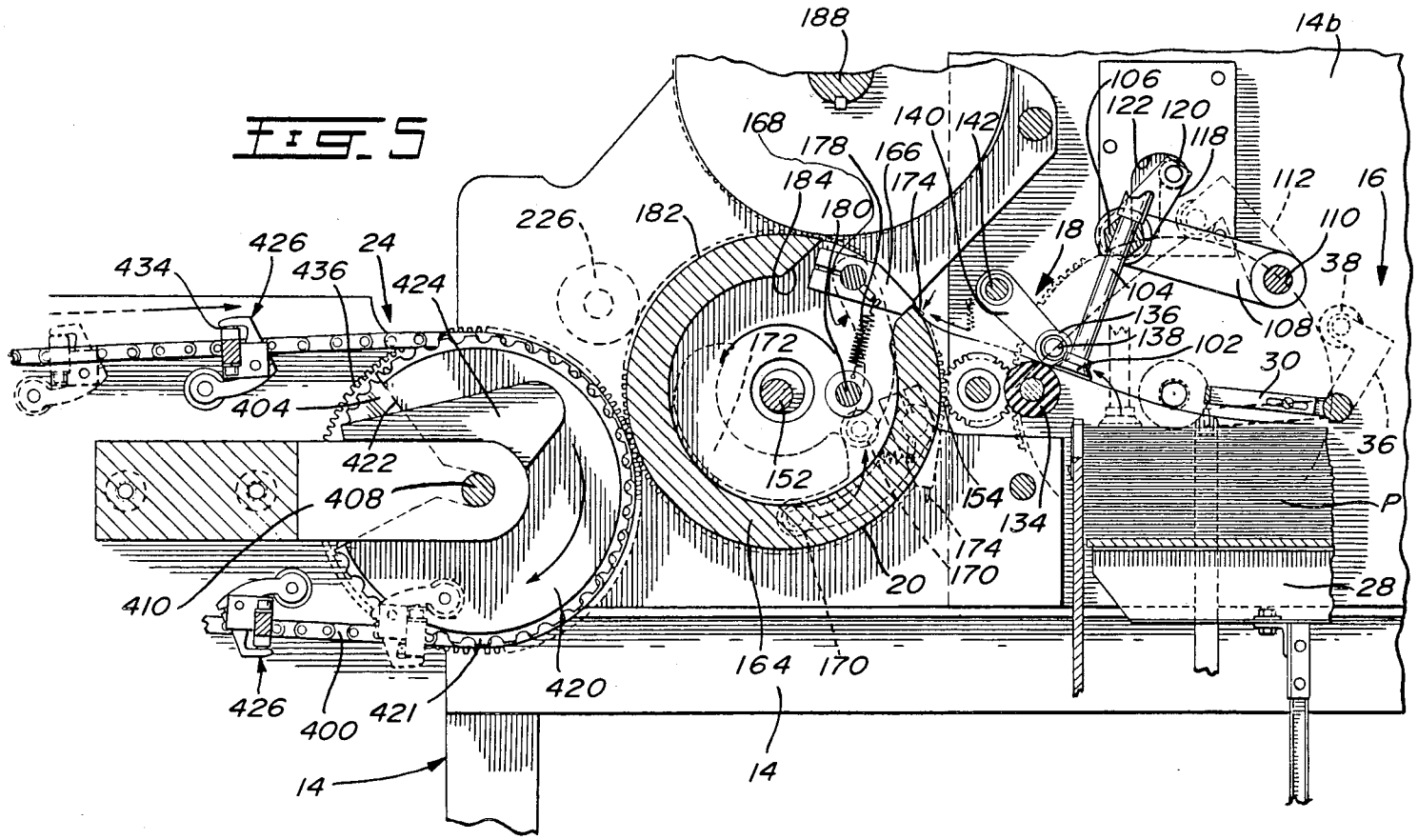
FIG. 5 is a further enlarged fragmentary view, partly in cross-section, of the apparatus as shown in FIG. 4.

As shown in the FIG. 5, a driven roller 134 is provided for receiving the sheet of paper being released by the suction cups 102. Pressure wheels 136 mounted on the shaft 138 form a nip with the driven roll 134 but are normally disengaged therefrom. The shaft 138 is mounted at both ends to levers 140 which in turn are mounted to a shaft 142 which passes at least through the wall **14*b* and mounts a lever 144 mounting a cam wheel follower 146 (see FIG. 8). Cam wheel follower 146 travels on the periphery of the cam wheel 148 mounted on shaft 42. The cam wheel 148 has a very slight off-circle portion which, when engaged by the cam wheel follower 146, forces the pressure wheels on the arms 140 to press against the drive roller 134. This is timed such that the pressure of the wheels 136 on the drive roller 134** is applied just when a sheet of paper is engaged by the nip.

Figure 16:
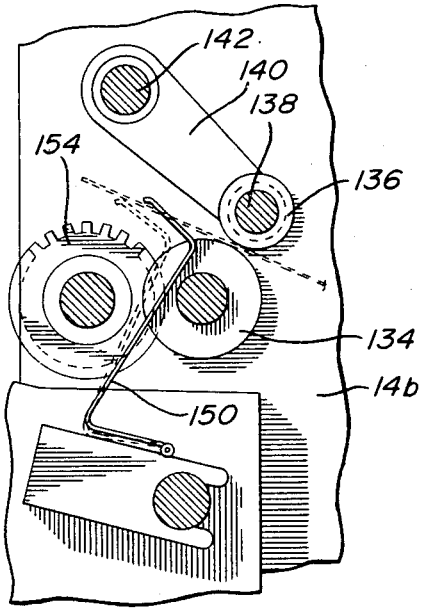
FIG. 16 is a vertical cross-section of the interrupter detector.

A microswitch feeler 150 is provided downstream of the nip formed by the drive roller 134 and the pressure wheels 136 as shown in FIG. 16. This will be described further.

Figure 6:
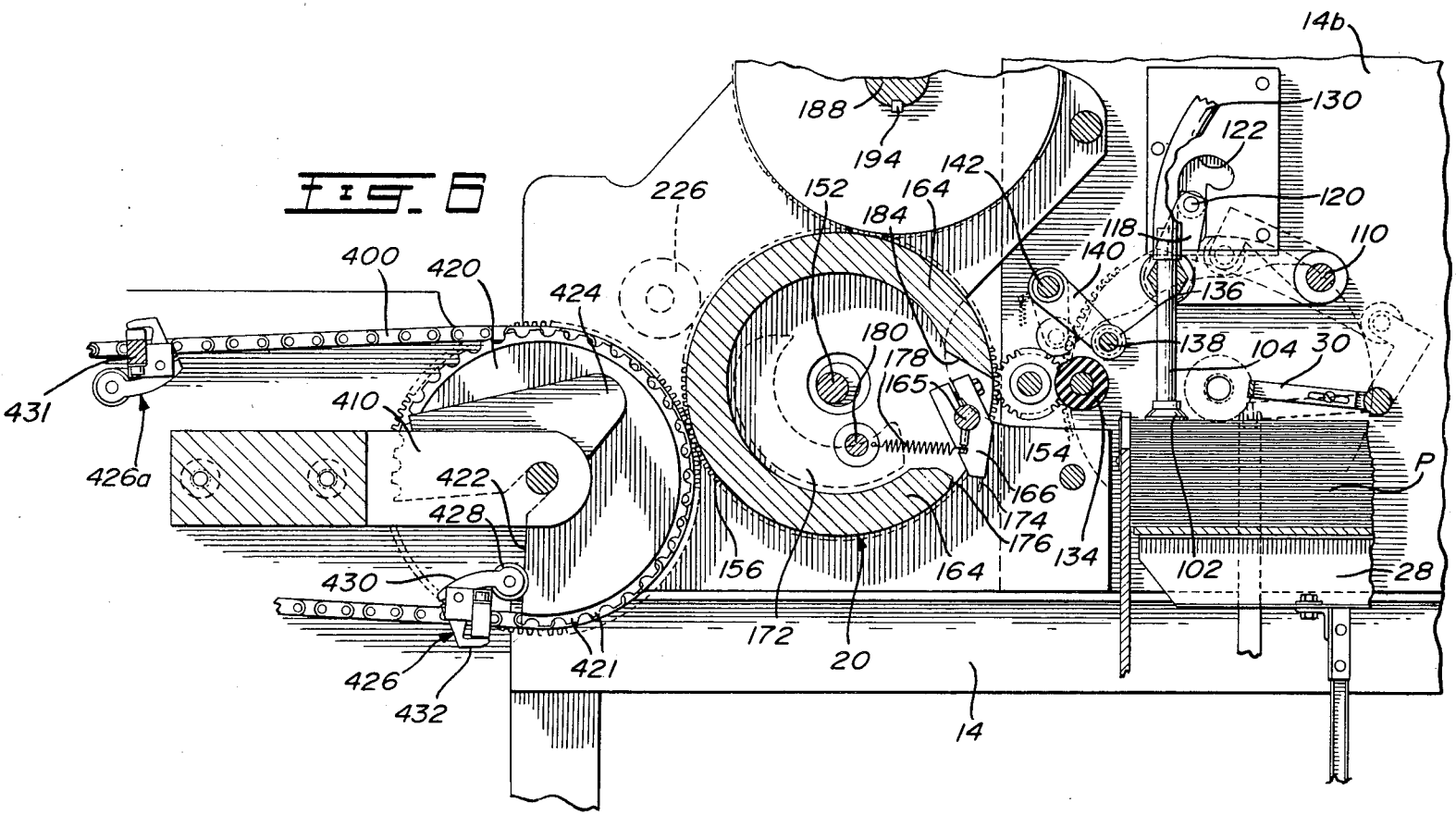
FIG. 6 is an enlarged cross-sectional view, similar to FIG. 5, but showing the elements in a different operating position.
Figure 7:
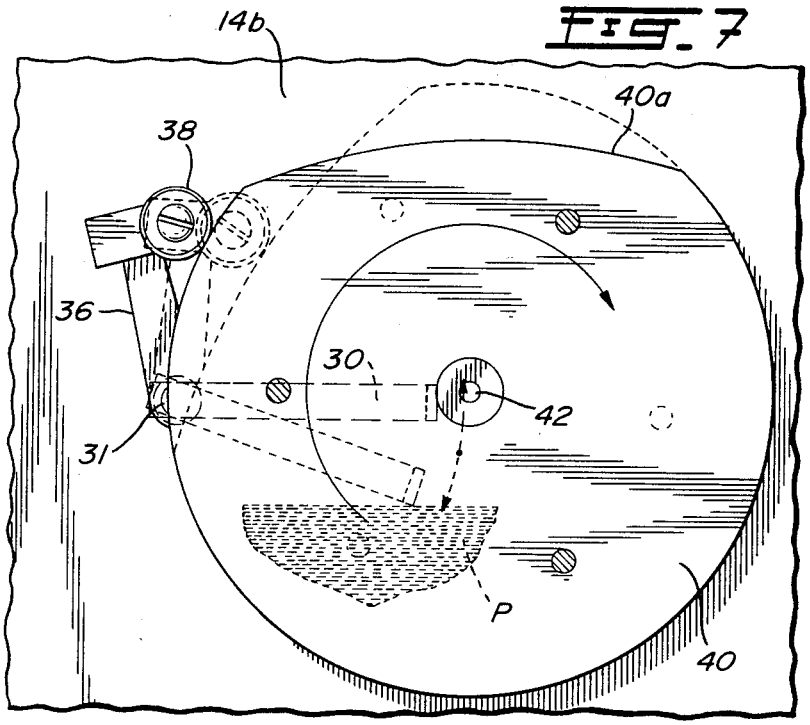
FIG. 7 is a fragmentary enlarged view of a detail of the apparatus, and in particular of the paper supply mechanism.
Figure 8:
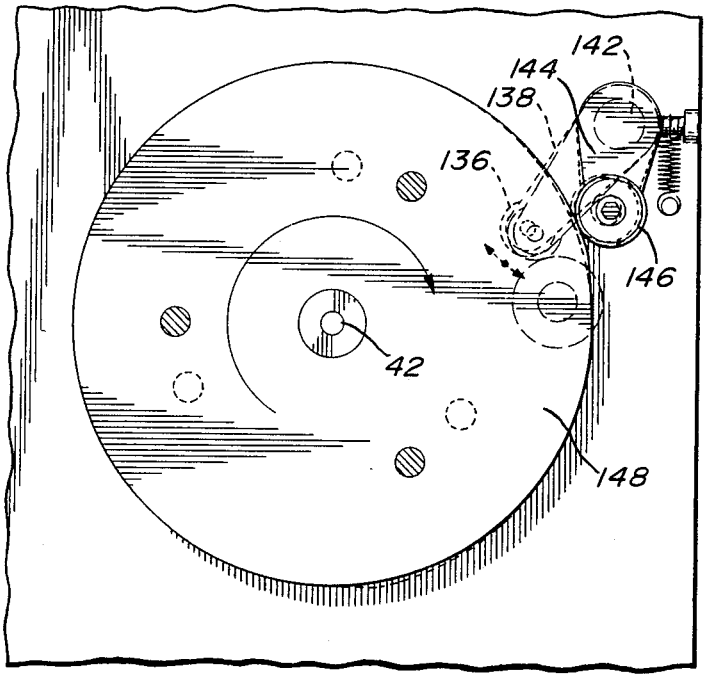
FIG. 8 is an enlarged fragmentary view of a further detail of the apparatus showing in particular the paper transfer mechanism.

The impression cylinder 20 is mounted eccentrically on a shaft 152, and the shaft includes enlargements 160 and bearings 162. The cylinder 20 includes a hoillow portion with an annular shell 164 defining an opening 184. As seen in FIGS. 5 and 6, a gripper device 166 is located in the opening 184. The gripper device 166 is clamped on a shaft 165. A plurality of gripper devices 166 are on the shaft 165, but for the purposes of simplicity, only one gripper device 166 will be described.

Each gripper device 166 is urged closed by means of a spring 178 attached at one end to a pin member 180. A cam arm 168, shown in dotted lines in FIG. 5, is connected to the gripper shaft 165 and mounts a cam follower wheel 170. During the rotation of the cylinder 20, the cam follower wheel 170 presses over the cam ridge 172, forcing the gripper 166 against the spring 178 to assume an open position as shown in FIG. 6. The gripper 166 is provided with a blade 174 which is adapted to close against the gripping surface 176 on the shell 164. As the cylinder 20 rotates in a counterclockwise manner, driven by gear wheels 154 and 156 about the shaft 152, the gripper will close as it passes the transfer mechanism 18 just as a sheet is being fed between the blade 174 and the surface 176, as best seen in FIG. 5. The gripper 166 will then entrain the sheet about the surface 182 of the cylinder 20 until it is approximately 190° from the transfer device, whereby the gripper means 166 will be forced to open by means of the cam ridge 172, and the delivery chain 24 will remove the sheet P as will be further described.

The various printing heads which are mounted on the shaft 188 must be provided with a slot which will register with the slot or opening 184 in the impression cylinder 20. It is important that such a slot be provided in the various printing heads or at least that the heads, such as the numbering head 202, do not coincide with the opening 184 so as not to press or otherwise interfere with the gripper 166.

Figure 17:
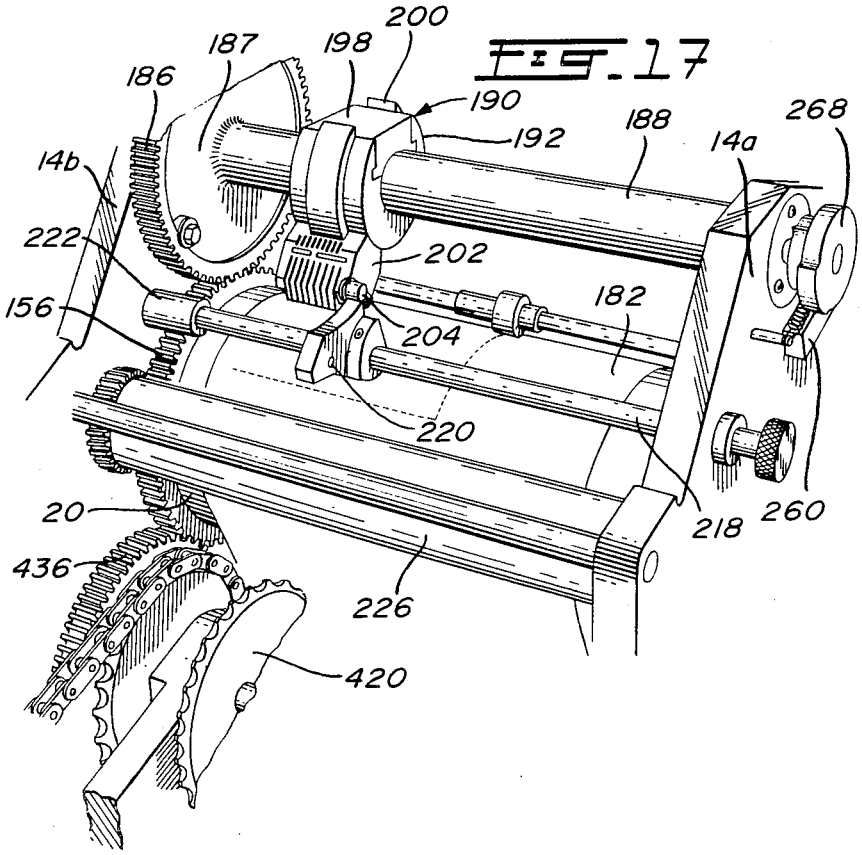
FIG. 17 is a perspective view of a detail of the apparatus and particularly showing the impression roller and the numbering apparatus.
Figure 18:
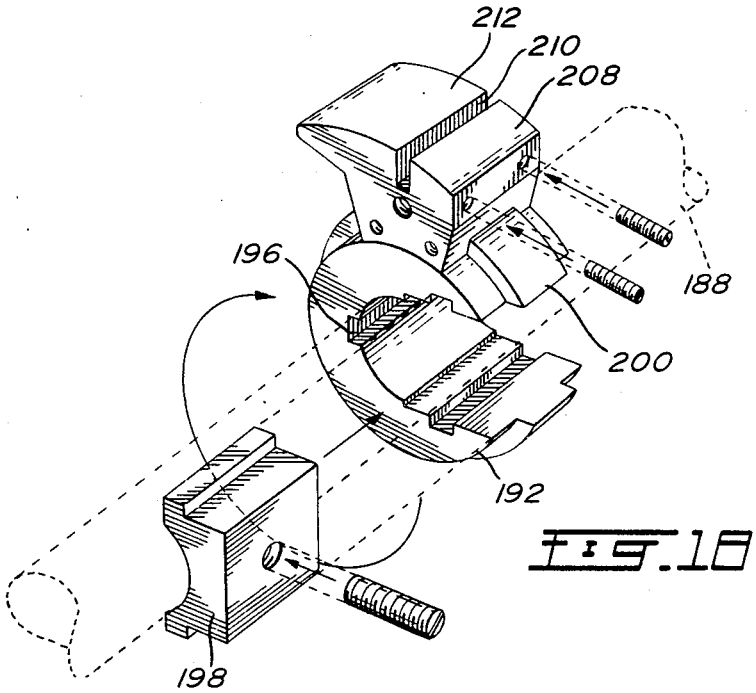
FIG. 18 is an exploded view of a further detail of the present invention and particularly a printing cylinder segment.
Figure 19:
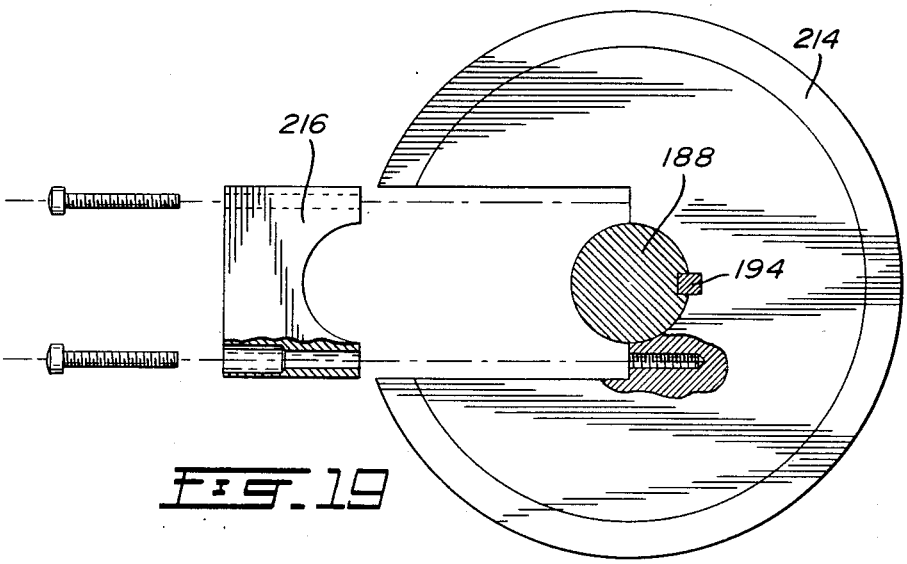
FIG. 19 is a radial view of a further detail of the present invention and showing particularly a printing cylinder.

Referring now to FIG. 17, there is shown a shaft 188 provided with a gear 186 meshing with gear 156 mounted to the cylinder 20. Shaft 188 is adapted to be provided with a number of printing accessories, including, as shown in FIG. 17, a numbering unit 190. In addition to the numbering unit 190, a printing cylinder 214, as shown in FIG. 19, can also be provided either in place thereof or in addition to the numbering unit 190. Also, a letterpress type printing head 208, as shown in FIG. 18, can be substituted or added onto the shaft 188. The printing cylinder 214 is best suited for a flexograph type soft printing pad while the letter press 208 can receive, within the slot 210, an insert with the printing characters protruding thereon.

As shown in FIGS. 17, 18, 22 and 23, the numbering unit 190, as will be described, includes a hodler 192 adapted to receive a key 194 in the keyway 196 thereof, and a holder locking insert 198 is provided thereon for retaining the holder in a registered manner on the shaft 188. A land 200 is provided on the holder 192 in order to properly locate the numbering head 202 thereon or any other printing head, such as printing head 208.

In association with the numbering unit 190, there is provided a shaft 218 on which is mounted a tripping cam 220. Shaft 218 is journaled in the sleeve 222 provided on both walls **14*a* and 14*b* and is actuated by the solenoid 232 as shown in dotted lines in FIGS. 22 and 23. A lever 234 (dotted lines) is fixed to the shaft 218**.

Figure 20:
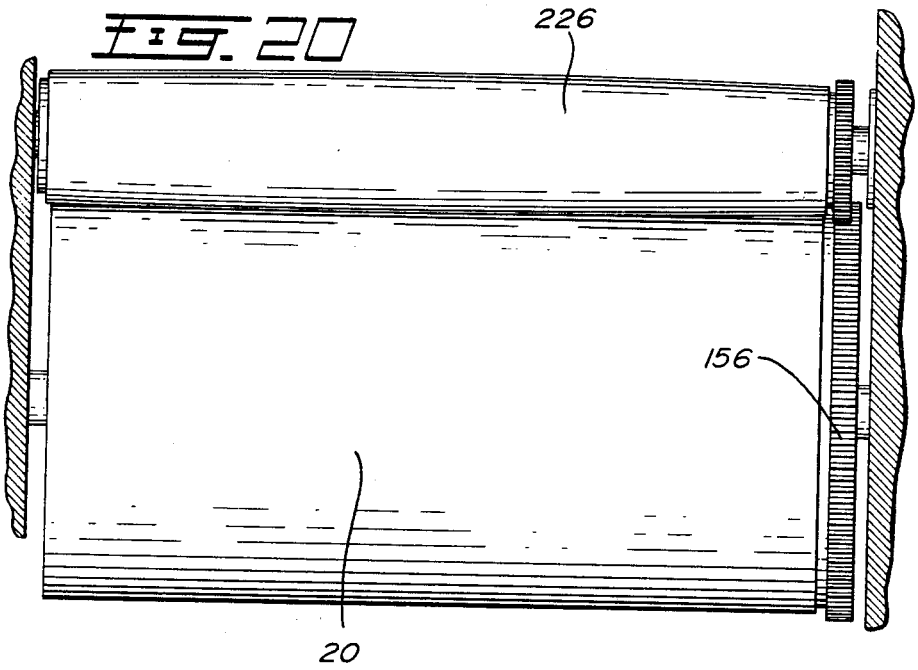
FIG. 20 shows a lateral elevation of the apparatus and in particular the counter roller and the impression roller.
Figure 21:
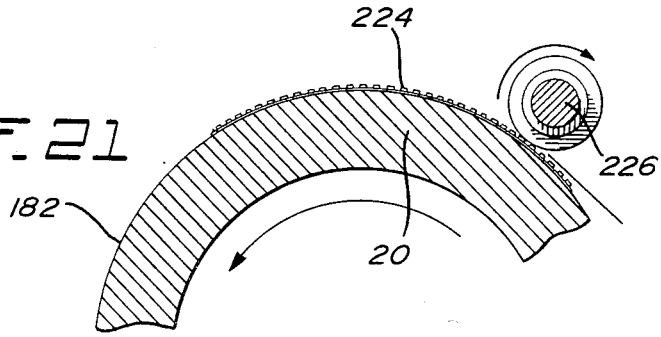
FIG. 21 is a fragmentary schematic end view of the counter roller and partial cross-section the impression roller and showing in particular a perforation mechanism.
Figures 24, 30:
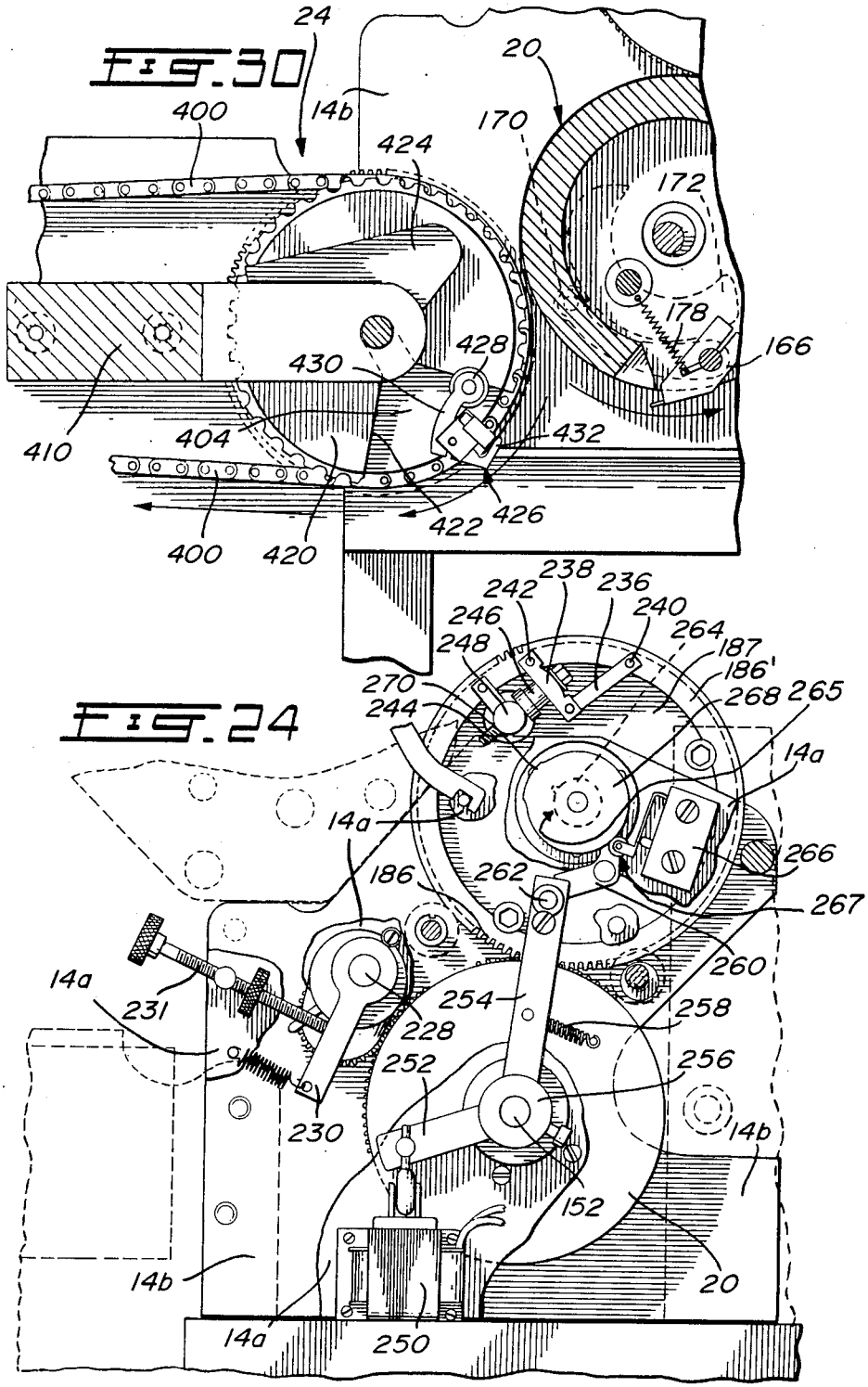
FIG. 24 is a fragmentary side elevation of a further detail of the present invention and in particular the interrupter mechanism.
FIG. 30 is a fragmentary cross-section similar to FIGS. 28 and 29, but showing the chain delivery in yet a different operative position.

As shown in FIGS. 20, 21, the impression cylinder 20 is adapted to receive on the surface 182 thereof perforating strips 224 including upstanding teeth, as are well known. The perforating strips 224 are located either laterally or peripherally of the cylinder surface 192. A counter roller 226, which has an axis parallel to the axis of the cylinder 20, is provided adjacent the cylinder 20 and has a longitudinally convex surface. The counter roller 226 presses the paper against the profecting teeth 224, thereby causing the sheet to be perforated. The counter roller 226 is mounted on an eccentric shaft 228 which can be angularly adjusted by means of lever 230 urged by spring 231, as seen in FIG. 24, by adjusting the micro-adjustment screw 231, thus increasing or decreasing the pressure of the counter roller 226 against the perforating strips 224. The counter roller 226 includes a longitudinally convex sleeve so as to compensate for the deflection of the outer sleeve when contacting the teeth.

As mentioned earlier, the impression cylinder 20 is mounted eccentrically on the shaft 152. Rotation of the shaft 152 in a clockwise direction will effectively move the impression cylinder 20 away from the shaft 188 on which the various printing heads may be mounted. In other words, the surface 182 of the impression cylinder 20 will be slightly spaced from the locus of the various printing devices which could be mounted on shaft 188. The mechanism for rotating the shaft 152 and thus moving the cylinder 20 from the path or locus of the printing devices is made up of the bellcrank arms 252 and 254 which are fixedly connected by means of a hub 256 on the end of the shaft 152. A solenoid 250 is connected to the bellcrank arm 252 while the other arm 254 mounts a pin 262.

A lock lever in the form of a bellcrank 260 includes a cam follower adapted to follow on the cam wheel 264, shown in dotted lines in FIG. 24. On the surface of the cam wheel 264, there is provided at least one bump 265 which is effective to disengage bellcrank 260 from a locked position with the pin 262 at each rotation of the cam.

The bellcranks 252 and 254 are retained in the position shown in FIG. 24 by lock lever 260 to maintain the cylinder 20 and its cylindrical surface 182 tangent to the path of the printing devices mounted on the shaft 188. A microswitch 266 includes a cam follower wheel 267 which travels on cam wheel 268 even when the bellcrank 260 is disengaged from the pin 262 at each rotation of the cam. When the cam follower 267 passes over the bump 270 of cam wheel 268, current which is furnished by microswitch 150 is allowed to pass to solenoid 250 in order to activate and maintain the cylinder retracted, thereby holding the shaft 152 in position. However, if in any one cycle of the shaft 188 and of the cylinder 20, the microswitch 150 should fail to be tripped by a sheet of paper, the microswitch 266 will be deactivated, thereby allowing the spring 258 to urge the bellcrank 252, 254 to rotate clockwise against the locked bellcrank 260. When the locked bellcrank 260 is disengaged from the pin 262 as previously explained, the bellcranks 252 and 254 will thus move clockwise on urging of the spring 258 thereby rotating the shaft 152, thus moving the impression cylinder 20 away. Any number of electrical circuits may be provided for operating the solenoid 250 from the microswitch 150.

Because of the timing factor of the cam wheel 264, the current may be fed to the solenoid 250 only when the bump 265 on the cam wheel 264 is approaching the follower on bellcrank 260 such that when the bellcrank 260 is disengaged from the pin 262, there is current passing through the solenoid, thereby activating it and retaining the bellcrank 252, 254 in its engaged position, as shown in FIG. 24. If the microswitch 150 fails to be tripped on any one cycle, the solenoid will, of course, not be activated, and the bellcrank arms 252 and 254 will rotate as the cam wheel 264 trips the bellcrank 260.

Figure 22:
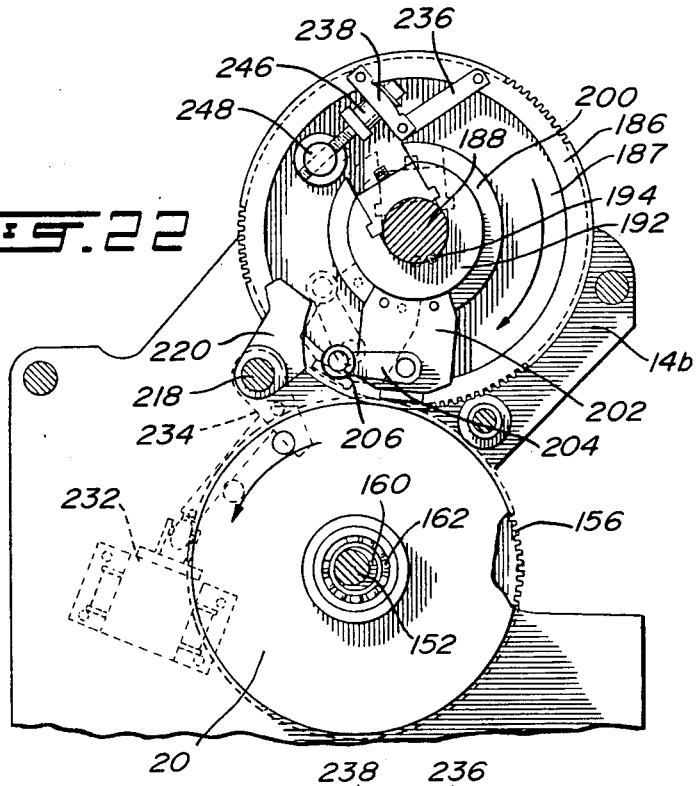
FIG. 22 is a fragmentary longitudinal cross-section of a detail of the apparatus showing in particular the numbering device in operation.
Figure 23:
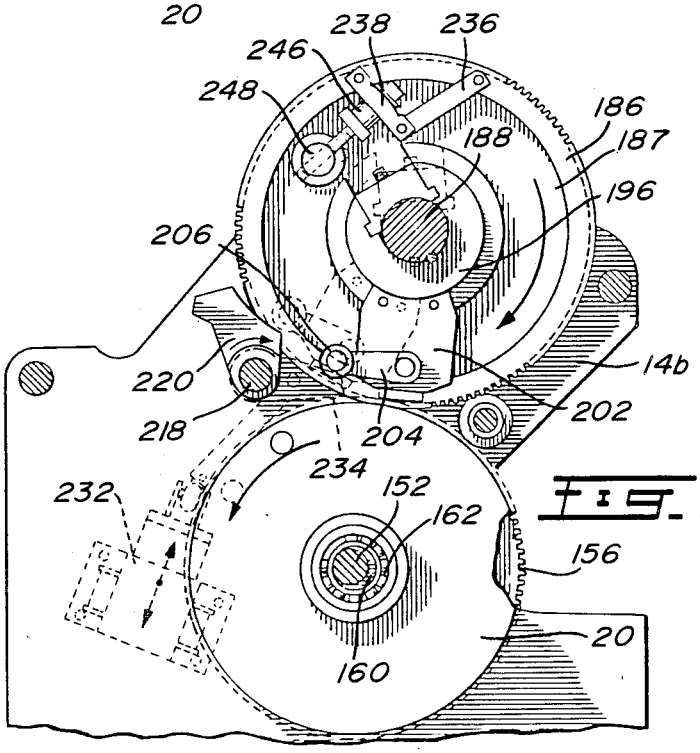
FIG. 23 is a cross-sectional view similar to FIG. 22 but showing the numbering device in a different operative position.

The solenoid 232 is affected by the signal from the microswitch 150. As shown in FIGS. 22 and 23, every time the solenoid 232 is activated, it will retract, drawing the lever 234 to rotate the tripping cam 220, thereby changing the number on the numbering head 202. However, if the microswitch 150 is not tripped at any one cycle, the current will not be sent to solenoid 232, thereby leaving the tripping cam 220 in the position shown in FIG. 23 for that particular cycle. Thus, the numbering head 202 will pass unchanged.

In fact, microswitch 266 provides the current to the solenoid 250 as its cam follower wheel 267 passes over the bump 270. The current, however, will not pass to the solenoids 232 or 250 when the microswitch 150 is not depressed by the paper.

Figure 25:
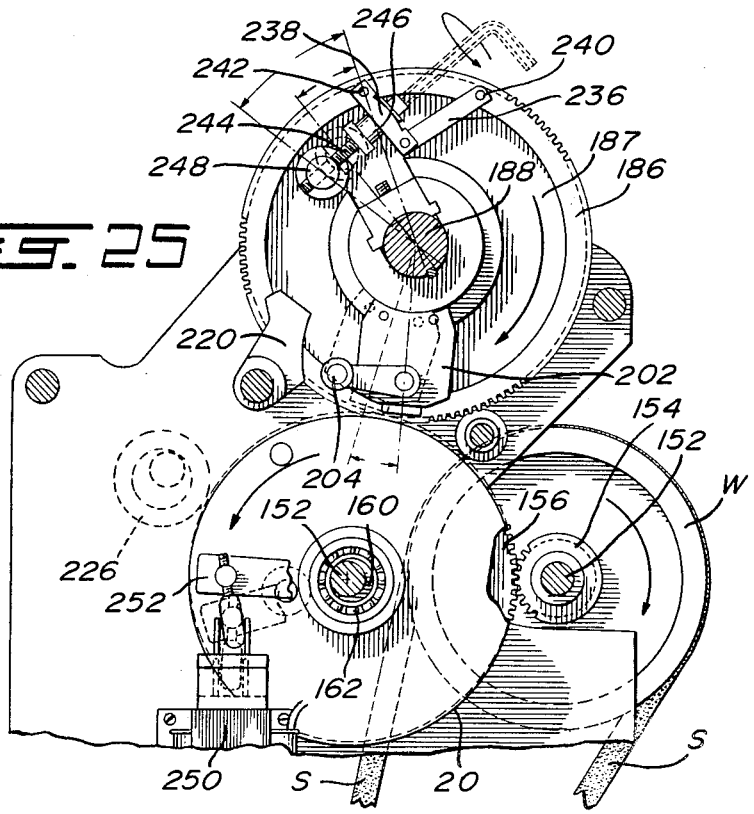
FIG. 25 is a longitudinal cross-section of the apparatus shown in FIG. 24 showing a further detail thereof.
Figure 4:
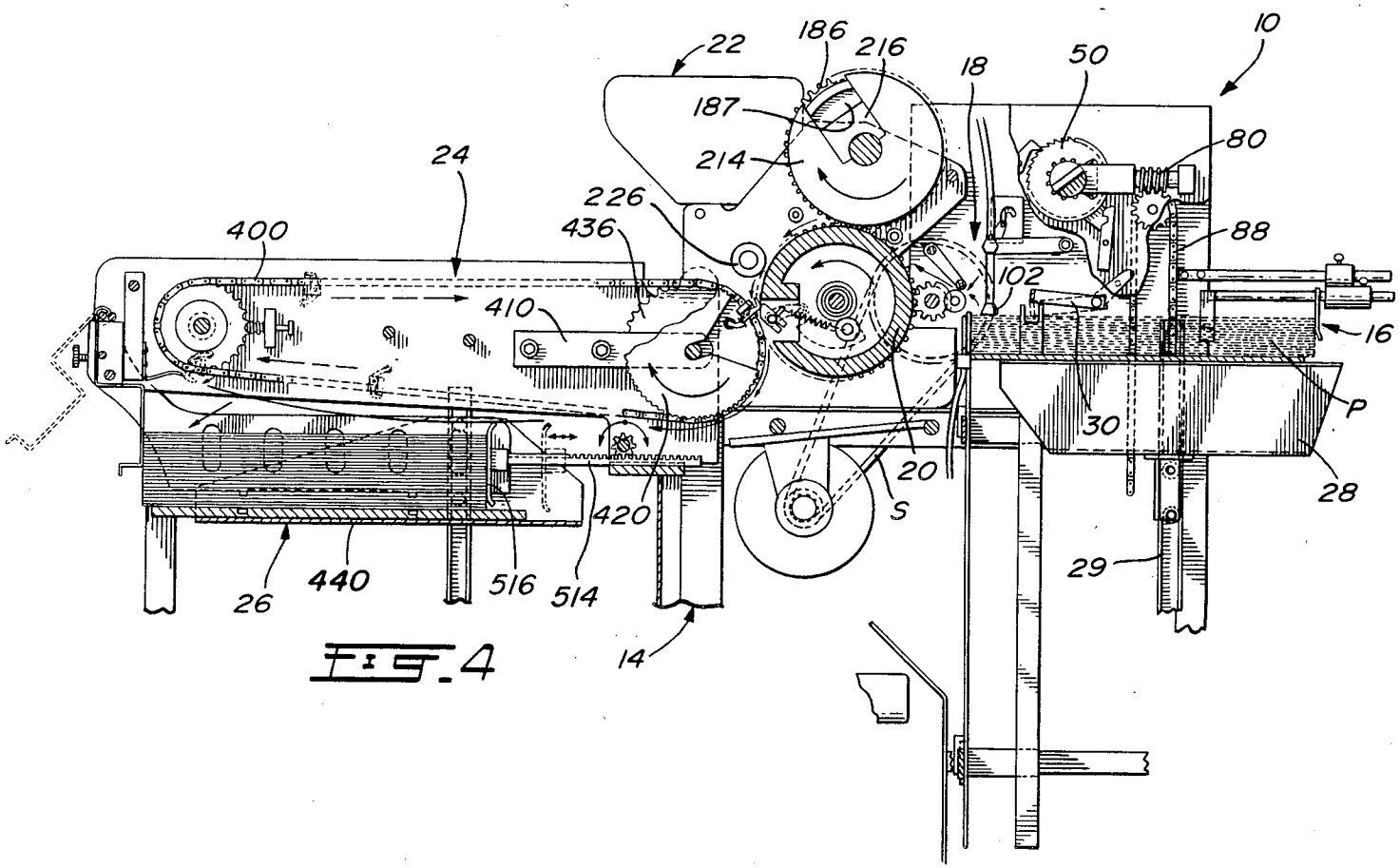
FIG. 4 is an enlarged fragmentary view, taken partly in cross-section and in elevation along the longitudinal axis of the printing press.

The gear rim 186 may be adjusted relative to the gear hub 187 in order to adjust the register of the shaft 188 relative to the impression cylinder 20. The adjustment mechanism includes an anchor 248 mounted to the hub 187 which is provided with a threaded aperture through which the threaded bolt 244 passes. The sleeve 246 is mounted to a link 238 which is in turn pivotally articulated to the gear rim 186. A link 236 pivotally mounted to the rim at 240 is also provided and is articulated with the link 238. As shown in FIG. 25, the head of the bolt 244 may be rotated by means of a suitable Allen screw for adjusting the rim 186 relative to the hub 187.

Figure 27:
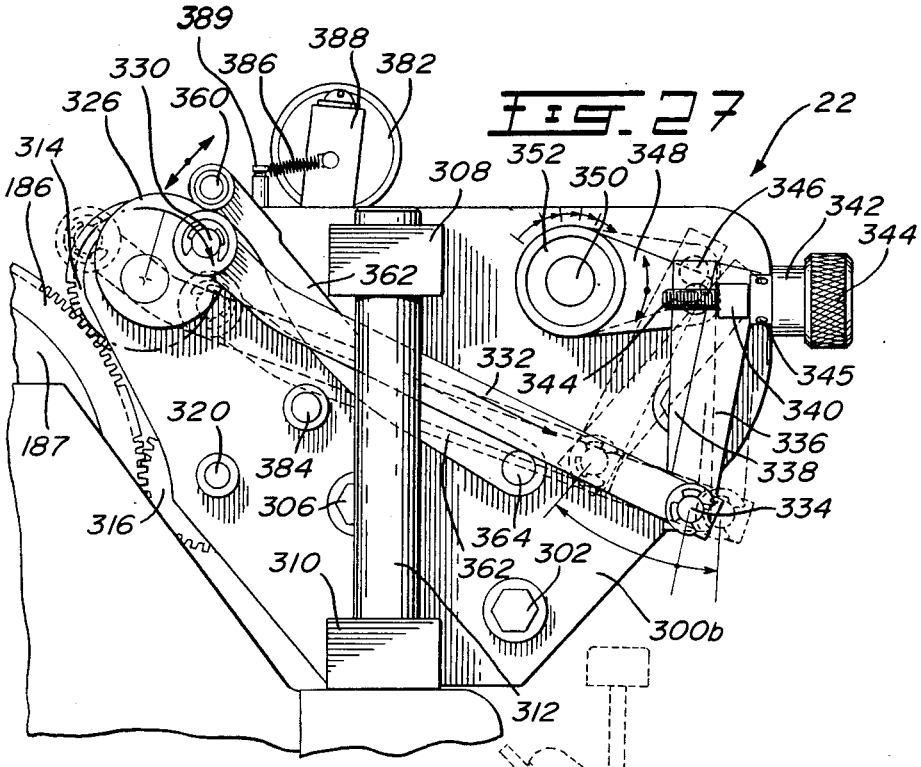
FIG. 27 is a side elevation of the apparatus showing in particular a detail of the ink unit.
Figure 26:
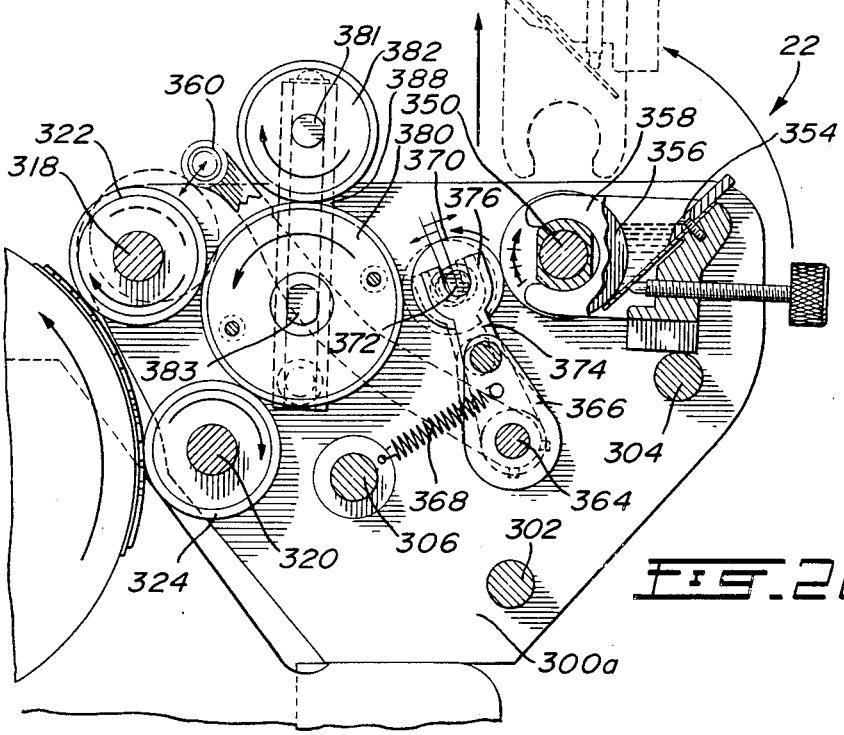
FIG. 26 is a longitudinal cross-section showing the ink unit.

The ink unit 22 is shown in FIGS. 2, 26 and 27. The ink unit 22 includes a sub-frame which includes opposed pairs of wall plates **300*a* and 300*b* supported together by connecting rods 302, 304 and 306. The wall 300*b* mounts pivot blocks 308 and 310 which are meant to be seated on an upstanding pivot rod 312 mounted to the frame 14. The ink unit 22 can be removed as one separate unit by lifting it from the pivot rod 312. It is also adapted to swing on the pivot rod 312 from a position shown in FIG. 2, for instance, where it is disengaged from the printing heads to a position shown in FIGS. 4, 26 and 27, where the walls 300*a* and 300*b* are parallel to the walls 14*a* and 14*b* respectively. The ink unit 22 also includes gear wheel 314, mounted to a shaft 318, and a gear wheel 316, mounted to a shaft 320 spacedly from gear wheel 314, wherein, in the last-mentioned position, both gear wheels 314, 316 mesh with gear wheel 186**.

The shaft 318 also mounts a cam wheel 326 on the outside of the wall **300*b*. The cam wheel 326 also acts as a crank wheel mounting a stub shaft 330 to which is connected a link 332. Link 332 includes a link pin 334 at the end thereof to which are mounted a pair of levers 336 and 338**.

Lever 336 is connected at its other end to a threaded sleeve 340 through which a threaded screw 344 passes. Screw 344 rotates in a bracket 342 mounted to the wall **300*b*. A sleeve 345 is also mounted on the screw 344 between the bracket 342 and the threaded sleeve 340 mounted on the lever 336. The other end of lever 338 is connected to a pivot 346 on a lever 348 which in turn is fixed to a ratchet bearing 352 on a shaft 350**.

Along opposite wall **300*a*, shaft 350 mounts the roller 356 in an ink reservoir 354 (FIG. 26). Reciprocating movement of the lever 348, as shown in dotted lines in FIG. 27, causes the roller 356 to rotate clockwise intermittently by way of the ratchet bearing 352**.

The stroke of the reciprocating lever 348 can be adjusted by the screw 344. As the screw 344 is rotated clockwise, it forces the lever 336 to reduce the angle with lever 338. As the angle between levers 336 and 338 decreases, the stroke of the lever 348 is reduced. However, as the screw 344 is adjusted in the opposite direction, the angle between the axis of lever 336 and 338 is increased, thereby increasing the stroke of the lever 348 and thus the speed at which the ink roller 350 passes through the ink well 354.

Another cam wheel 322, mounted on shaft 318 (FIGS. 26, 27), has a peripheral surface which is eccentric to the shaft 318, and a cam follower 360 follows the periphery of the cam wheel 22 giving the arm 362 a reciprocating angular movement. The arm 362 is fixed to the shaft 364, as shown in FIG. 26, to which is mounted a first lever 366 connected by a spring 368 to the connecting rod 306, thereby urging it in a counterclockwise direction.

A pair of levers 374 support by their yoke ends 376 a shaft 372 mounting a transfer roller 370. The angular movement of the arm 362 reciprocates the lever 374, thereby moving the transfer roller 370 between a position in contact with the ink roller 356 and the transfer roller 380. The transfer roller 380, which is mounted on a shaft 383 adapted to vertical slide in a slide bracket 388, is in turn mounted to pivot 384 and presses against the rollers 322 and 324 to transfer ink thereon to these rollers. A spreading roller 382, mounted on a shaft 381 slidable in brackets 388, presses downwardly against the roller 380 in order to spread the ink thereon in a thin film as the ink is intermittently placed on the periphery of the roller 380 by means of the transfer roller 370. The bracket 388 is urged against the rollers 322 and 324 by mean of a spring 386 connected to the bracket 388 and to an upright projection 389 extending from the top edge of wall **300*b***.

The take-off of the paper sheet from the impression roller 20 can be provided in many ways. For instance, a conventional chain delivery can be provided which will be briefly described herein. On the other hand, a chute can be provided adjacent the impression roller for removing the sheets from the roller after the gripping device 166 has released the sheet.

Figure 28:
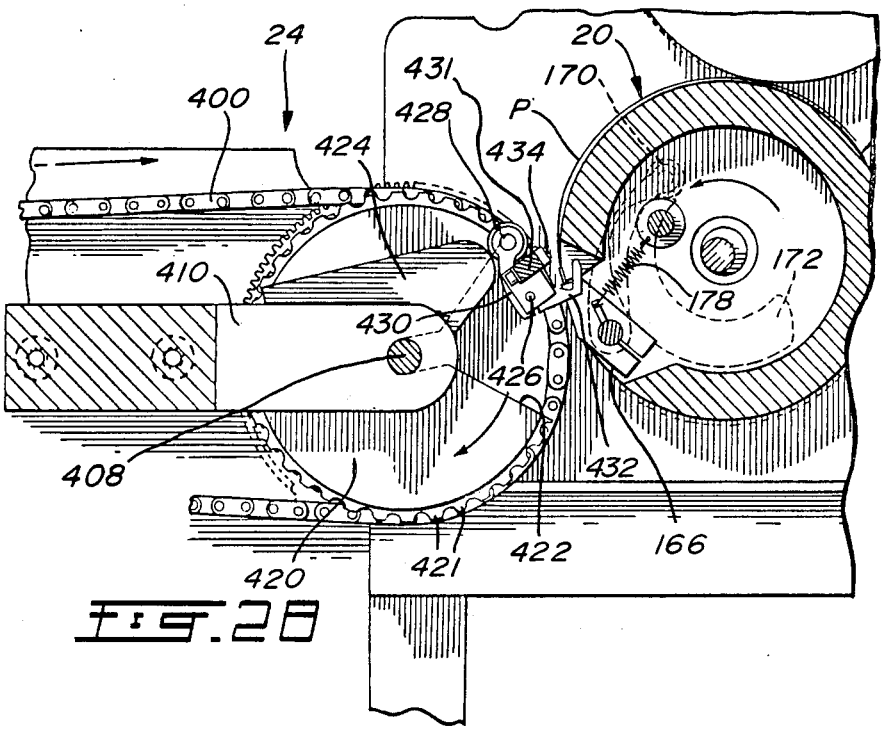
FIG. 28 shows a fragmentary cross-section of the longitudinal cross-section of a detail of the apparatus and in particular the chain delivery.
Figure 29:
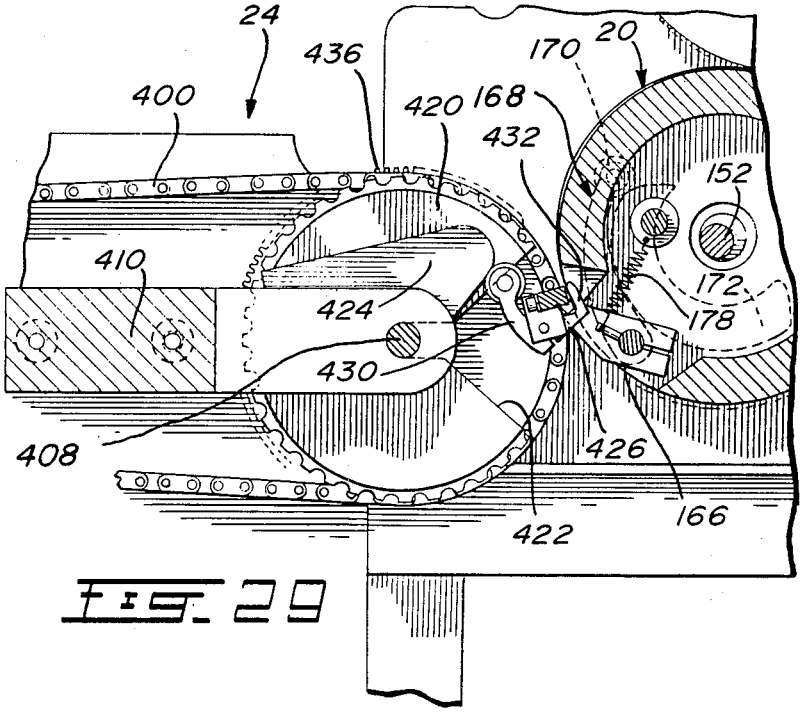
FIG. 29 is a fragmentary cross-section similar to FIG. 28 but showing the chain delivery in a different operative position.

In the present embodiment, a chain delivery has been described. As previously mentioned, the gripper 166 which includes a cam follower arm 168, will release the paper as its cam follower arm wheel 170 engages the cam ridge 172 as the impression roller 20 rotates counterclockwise. FIG. 28 shows the position in which the cam follower wheel 170 engages the ridge 172, and FIG. 29 shows the next operative position whereby the gripper 166 has released the paper as the cam follower wheel 170 rides on the cam ridge 172.

The chain delivery 24 includes, a shown in FIGS. 2, 5, 6, 28, 29 and 30, a pair of chains 400 and 402, which travel about respective pairs of sprockets 404, 414, and 406 and 416. The sprockets 404 and 406 are mounted on a shaft 408 which in turn mounts a gear wheel 436 adapted to mesh with the gear wheel 156 (FIG. 6) on the impression cylinder 20. The shaft 408 also mounted a plurality of spaced-apart spacer wheels 420 (FIG. 2) which together form what is known as a false cylinder. Each spacer wheel 420 is provided with teeth 421 and a sector-shape opening 422 merging with the central through bore of wheel 420 through which extends shaft 408. Opening 422 registers with the opening 184 in the impression cylinder so as to avoid interference with the gripper 166 mounted in the opening 184 of impression cylinder 20. The shaft 408 is mounted on a pair of sub-frames 410 and 412, as shown in FIG. 2.

Each chain 400 and 402 subtends a plurality of spaced-apart grippers 426. A cam device 424 is mounted to the sub-frame 410, for instance, and is meant to coact with consecutive grippers 426. The grippers 426 are arranged on the chains 400 and 402 so that they coincide with the openings 422 when they pass over the spacer wheels 420. Each gripper 426 includes a gripper bar 431 extending between the chains 400 and 402 with levers 430 pivoted thereon to which is mounted a jaw 432. The jaw 432 is meant to open and close against the bar 431 of the gripper 426, and a rubber pad 434 may be provided on the face of the. bar 431 so as to engage the paper P. The lever 430 mounts a cam follower 428 which is adapted to follow on the cam 424, thereby opening the jaw 432 when the gripper 426 approaches the tangential position relative to the periphery of the cylindrical surface 182 of the impression cylinder 20. As the jaw 432 passes the position shown in FIG. 28, it is open and is adapted to close on the edge of the sheet P to relieve the sheet from the gripper 166. As seen in FIG. 29, once the jaws are closed thereon, the paper sheet P will be entrained about the false cylinder formed by the spacer wheels 420 and will be carried on the bottom race of the chain 400, for instance. A flat tray can be provided below the race to allow the sheets to slide thereon. The chain delivery is designed to release the sheet of paper over the stacker 26.

Figure 31:
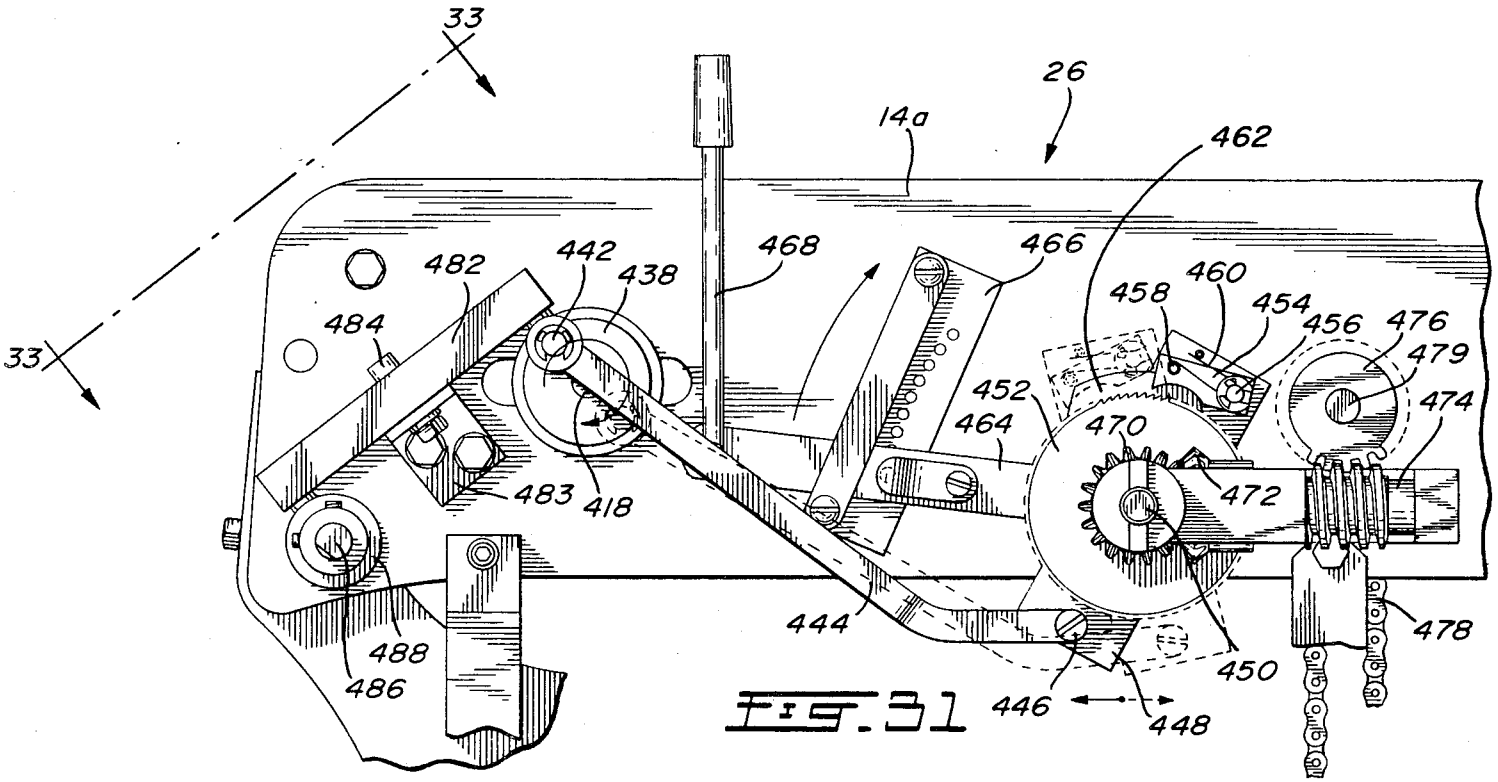
FIG. 31 is a fragmentary view in side elevation of a detail of the apparatus and in particular the stacking unit.
Figure 32:
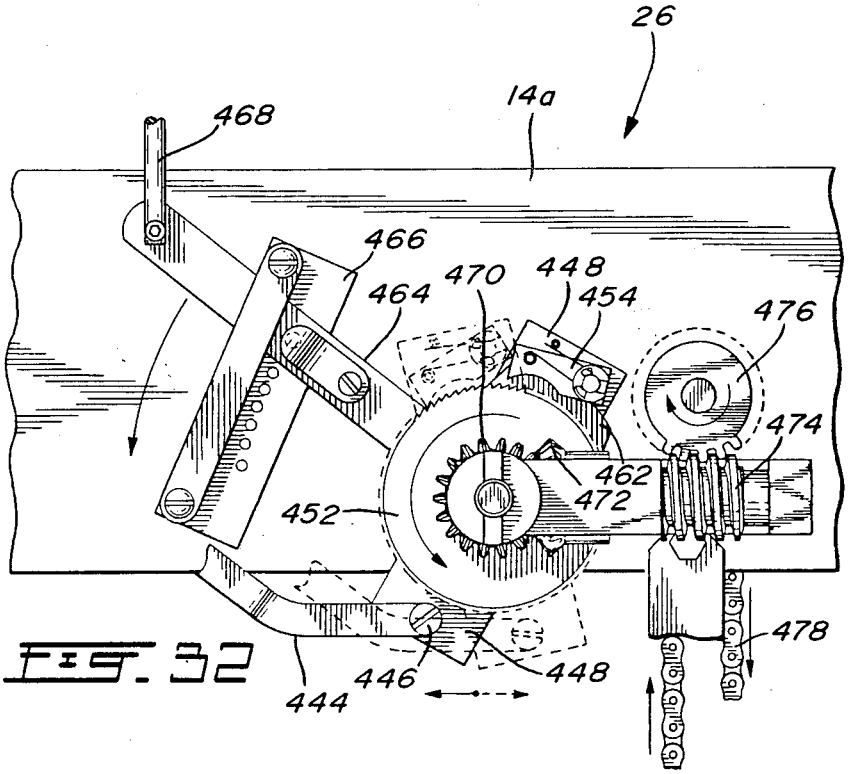
FIG. 32 is an enlarged detailed view of the apparatus shown in FIG. 31 but in a different operative position.

Stacker 26 is shown in FIGS. 31 to 34. A tray 440 (FIG. 4) is provided between the frame walls **14*a* and 14*b*, and a mechanism for lowering the tray is illustrated in FIGS. 31 and 32; this mechanism includes chains 478 to which tray 440 is attached. The mechanism includes a crank wheel 438 mounted on an extension of the shaft 418 past the wall 14*a*. The crank wheel mounts an eccentric stub shaft 442 to which an arm 444 is connected. The other end of the arm 444 is pivotally connected to a lever 448 by means of a pivot pin 446. The lever 448 pivots on the shaft 450 which mounts a toothed wheel 452 (the teeth being of the sawtooth type) as well as a ratchet lever 454 pivoted to the pivot pin 456 on the lever 448**.

A cam 462 is also pivotally mounted to the shaft 450 and is fixed to a lever 464 which is adapted to be angularly adjusted in the bracket 466. A handle 468 is provided for adjustment of the lever 464. The ratchet lever 454 is provided with a spring 460 urging the lever towards the toothed wheel 452. One end of the spring abuts against a cam pin 458 which rides on the cam 462. The position of the cam 462 is determined by the position of the lever 464 in and the bracket 466 and the position of cam 462 will determine the effective length of movement that the lever ratchet 454 will be engaged on the toothed wheel 452. For instance, when the cam 462 is in the position as shown in FIG. 32, the ratchet lever 454 will engage the toothed wheel 452 for a much longer distance in its stroke than when the cam 462 is in the position as shown in FIG. 31. This results in a faster descent of the tray 440 as will be explained further.

Also mounted on shaft 450 is a bevel gear 470 which is engaged with bevel gear 472 on the end of a worm gear 474 rotatably carried by wall **14*a*. Worm gear 474 turns the gear 476 which is mounted on a shaft 479. Although not shown, a pair of sprockets are provided on the shaft 479 about which chains 478** are entrained.

As the crank wheel 438 rotates clockwise, the arm 444 will reciprocate a given distance, as shown in dotted lines in FIGS. 31 and 32. The cam 462, as previously explained, will determine the length of travel that the ratchet 454 will engage the toothed wheel 452. The toothed wheel 452, as it rotates counterclockwise, also rotates the bevel gear 470 and thus the bevel gear 472 and, therefore, the worm gear 474 and the gear 476. For each intermittent advance thereof, the chain 478 will lower the tray 440 a proportional distance.

Figure 33:
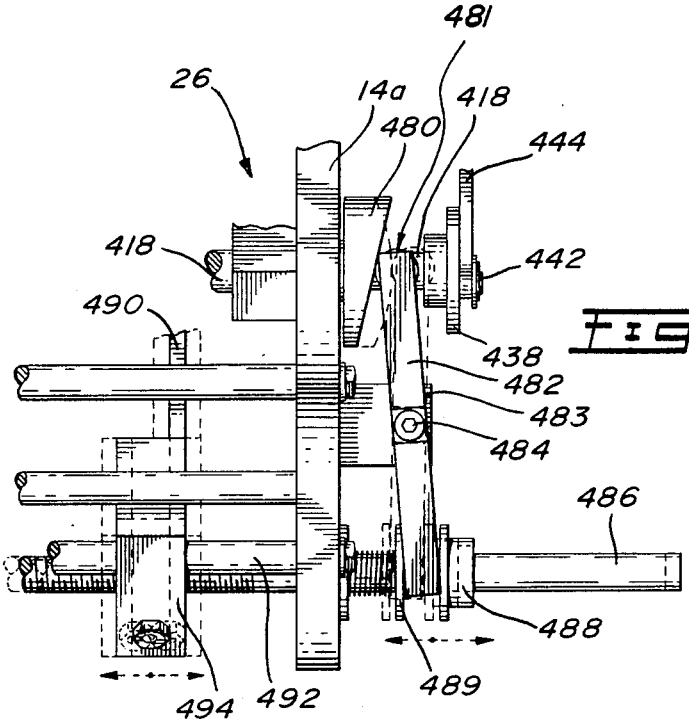
FIG. 33 is a detail taken along the lines 33—33 if FIG. 31.

Referring now to FIG. 33, it will be evident that behind the crank wheel 438 is provided a cam path determined by a cam wheel 480, which causes pivoting movement of a follower 481 on lever 482 which is intermediately pivoted at 484 on the bracket 482 fixed to the frame wall **14*a*. A follower on the other end of the lever 482 travels between sleeves 488 and 489 mounted on a sliding rod 486. The other end of the rod 486 is threaded and engages in a bracket 494 which slides on a guide rod 492. A jogger plate 490 is fixed to the bracket 494 and reciprocates a given distance, as shown in dotted lines in FIG. 33, in response to the action of the cam wheel 480 on the lever 482. The jogger plate 490 is effective to maintain sidewise alignment of the sheets of paper which are being deposited on the tray 440 by the chain delivery 24. As shown in FIG. 2, there are two plates on either side of the stack but only plate 490 reciprocates. Plate 491** is static.

Figure 34:
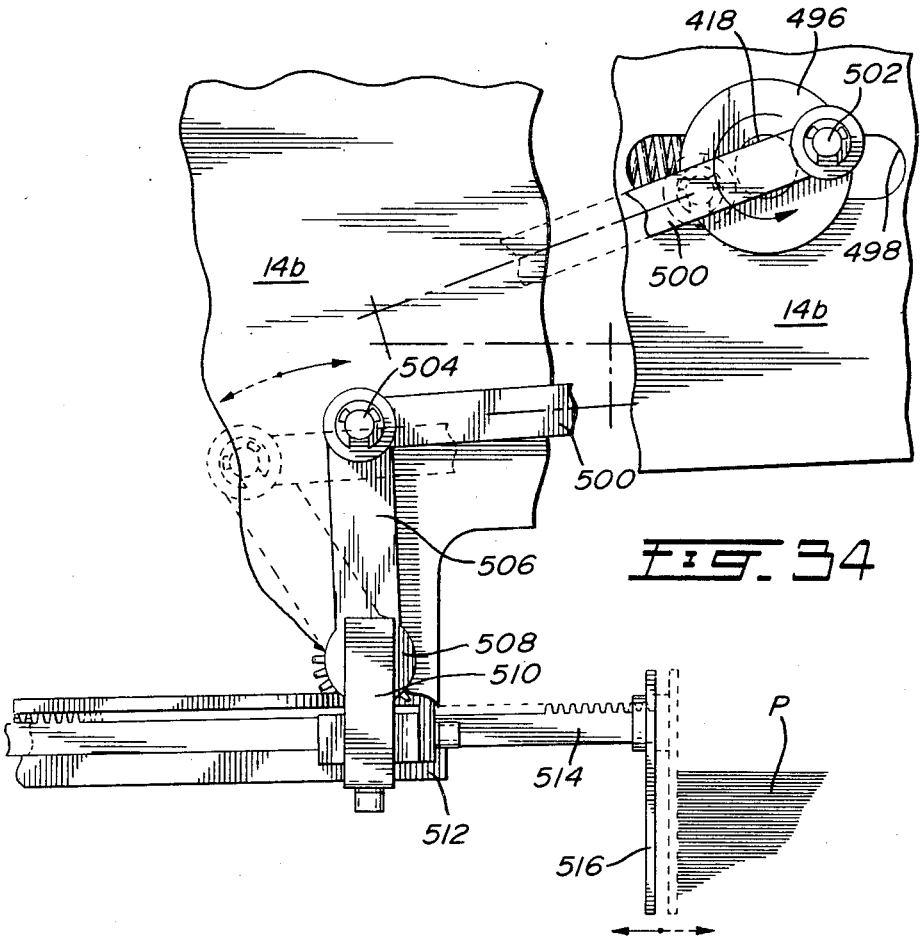
FIG. 34 is a further detail of the stacking and jogging device.

On the other side of the frame 14, that is, on frame wall **14*b*, there is provided, as shown in FIG. 34, a crank wheel 496 mounted on the shaft 418. A stub shaft 502 is eccentrically mounted on the crank wheel 496, to which is connected an arm 500 which is pivotally connected at pin 504 to a lever 506 which in turn is fixedly connected to a shaft 513 (FIG. 2) which is journaled to bracket 510. The shaft 513, mounts a gearwheel 508 which in turn engages a rack 514 sliding in a track 512. The end of the rack 514 is provided with a jogger plate 516 which reciprocates, as shown in dotted lines in FIG. 34, to align the ends of the sheets of paper P in the stack. As seen, the reciprocating movement is caused by the crank wheel 496 which, through the levers 500 and 506, causes the gear 508 to reciprocate the rack 514**.

What I claim is:

1. A printing apparatus for letterpress work comprising a frame, an impression cylinder mounted for rotation on the frame, means for feeding sheets of paper to the impression cylinder, means provided on the impression cylinder for successively retaining the sheets of paper on the surface of the impression cylinder as the latter rotates through a predetermined arc, a shaft mounted on the frame in spaced relation and parallel to the axis of rotation of the impression cylinder and contained within said arc, driving means for driving said impression cylinder and said shaft in registry, a group of printing elements including a numbering device, a letter press head and a flexographic printing cylinder; means for releasably mounting said printing elements on said shaft such that said printing elements contact said impression cylinder surface within said arc, removable ink means including at least an ink roller positioned for directly contacting and transferring printing ink to the printing elements on said shaft, a perforation strip releasably carried on the surface of the impression cylinder, and a counter roller mounted on the frame adjacent the impression cylinder within said predetermined arc and driven by said driving means to press a sheet of paper on the impression cylinder passing through said arc against the perforation strip, in order to perforate the sheet of paper, said printing elements and said counter roller all concurrently actuatable upon rotation of said impression cylinder, so that said printing elements and perforating strip can accomplish their respective printing and perforating functions on the sheet retained on said impression cylinder, anyone of said printing elements and said perforating strip attachable to said shaft and impression cylinder, respectively, so that one or more of said printing elements and perforated strip can accomplish its function, and means for removing the sheet of paper from the imprssion cylinder at the end of said predetermined arc.

2. A printing apparatus as defined in claim 1 wherein the numbering device includes a numbering printing head traveling in a circular locus tangentially intersecting the ink roller and the impression cylinder surface, the numbering head being provided with a trip lever adapted to sequentially change the numbers on the numbering printing head, a further shaft mounted on said frame and parallel to the shaft mounting the numbering device, the further shaft including a cam means adapted to move between a first position in place to trip the lever on said numbering device head on each rotation of the numbering device on said shaft, and a second position clear of said trip lever on said numbering device.

3. A printing apparatus as defined in claim 1, wherein the counter roller has as axis of rotation parallel to the axis of rotation of the impression cylinder and is driven in registry with said impression cylinder, and the outer surface of the counter roller is longitudinally convex such that this outer surface will deflect when in contact with the paper against the perforation strip.

4. A printing apparatus as defined in claims 1 or 3, wherein the counter roller is mounted on a first eccentric shaft in a pair of journals in the frame such that the pressure of the counter roller against the impression cylinder may be adjusted by adjustment means associated with said first eccentric shaft.

5. A printing apparatus as defined in claim 2, wherein sensor means are associated with the means for feeding sheets of paper to the impression cylinder for sensing any interruption in the supply of sheets of paper to the impression cylinder, first interrupter means responsive to said sensor means for moving the impression cylinder away from the locus of the printing surfaces of the printing elements such that these printing elements will be out of contact with the impression cylinder surface, and second interrupter means responsive to the sensor means to maintain the cam means on said further shaft in said second position out of contact with said trip lever on said numbering head.

6. A printing apparatus as defined in claim 5, wherein the first interrupter means include an eccentric shaft for mounting said impression cylinder on said frame, and means are provided for rotating the said eccentric shaft through a predetermined arc, such as to effectively move the impression cylinder away from contact with said printing elements.

7. A printing apparatus as defined in claim 6, wherein the means for rotating the said eccentric shaft includes a bellcrank lever fixed to an end of the said eccentric shaft and operable by a solenoid to move the bell crank lever, thus rotating the said eccentric shaft on receipt of a signal from the sensor means.

8. A printing apparatus as defined in claim 5, wherein a solenoid is operably connected to said further shaft for moving the cam means from the first position operable to trip the trip lever on the printing head to the second position away from any contact with said trip lever, the solenoid being operable, on receipt of the signal from said sensor means in the event of an interruption in the supply of sheets of paper, to move and maintain the cam means in the second position.

9. A printing apparatus as defined in claim 1 or 5, wherein the impression cylinder is hollow and includes a recess extending laterally of the surface thereof communicating with the hollow center of the cylinder and the means for successively retaining the sheets of paper includes a plurality of pivoting gripping heads mounted within the hollow portion of the cylinder at the recess, means for operating the gripping heads such that they grip the edge of a sheet of paper being fed to the impression cylinder against the surface of the impression cylinder adjacent and downstream of the recess, and means for pivoting the gripping heads to release the sheet of paper after a predetermined arc has been completed and wherein a chain delivery assembly is provided downstream of the impression cylinder which includes a pair of conveyor chains extending parallel and passing about longitudinally-spaced pairs of sprocket assemblies, one pair of sprocket assemblies being adjacent the impression cylinder, gripping means provided on the chain delivery system and subtended between the pair of chains, said gripping means to be operable to grip the sheet of paper as it is being released by the gripping heads on the impression cylinder for removing the sheet of paper from the impression cylinder and delivering the sheet of paper to a stacking device.

10. A printing apparatus as defined in claim 1 or 5, wherein the ink means include a subframe pivotally mounted to the frame of the printing apparatus, such that the subframe can be swung about a vertical axis relative to one side of the frame into engagement with the printing apparatus or out of engagement therewith, the ink means including an ink well and a plurality of laterally-extending transfer rollers mounted adjacent the ink well and adapted to transfer a discrete amount of ink to said ink roller and to a second ink roller tangent with the locus of the printing surface of the printing elements on the shaft.

11. A printing apparatus as defined in claim 1, wherein the flexographic cylinder is a part cylinder removably mounted on the shaft, and further including holders, each partly cylindrical and defining a radially-extending opening having a width at least the width of the diameter of the shaft, an insert removably fitted within said opening for firmly holding said holders to the shaft, key and keyway means securing said part cylinder and said holders to said shaft, and a circumferential land provided on the surface of the holders to which the numbering device and the letter press head can be fixedly mounted in angularly-adjusted position relative to said holders.

* * * * *